US009181491B2

(12) United States Patent
Kibby et al.

(10) Patent No.: US 9,181,491 B2
(45) Date of Patent: Nov. 10, 2015

(54) PROCESS AND SYSTEM FOR BLENDING SYNTHETIC AND NATURAL CRUDE OILS AND BLENDS MADE THEREBY

(71) Applicant: Diana Lynn Kibby, Benicia, CA (US)

(72) Inventors: Charles Leonard Kibby, Benicia, CA (US); Dennis John O'Rear, Petaluma, CA (US); Robert James Saxton, San Rafael, CA (US); Tapan Kumar Das, Albany, CA (US); Kandaswany Jothimurugesan, Hercules, CA (US); Allison Amy Evans, Richmond, CA (US); Michelle Hart, Richmond, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 15 days.

(21) Appl. No.: 14/163,226

(22) Filed: Jan. 24, 2014

(65) Prior Publication Data

US 2014/0142204 A1 May 22, 2014

Related U.S. Application Data

(63) Continuation-in-part of application No. 12/974,337, filed on Dec. 21, 2010, now Pat. No. 8,753,500.

(60) Provisional application No. 61/291,639, filed on Dec. 31, 2009.

(51) Int. Cl.

| | |
|---|---|
| ***C10G 9/00*** | (2006.01) |
| ***C10G 2/00*** | (2006.01) |
| ***C10G 45/02*** | (2006.01) |
| ***C10G 45/58*** | (2006.01) |
| ***C10G 47/00*** | (2006.01) |
| ***C10G 49/00*** | (2006.01) |
| ***C10G 5/06*** | (2006.01) |

(52) U.S. Cl.

CPC *C10G 2/32* (2013.01); *C10G 2/332* (2013.01); *C10G 2/333* (2013.01); *C10G 2/341* (2013.01); *C10G 2/344* (2013.01); *C10G 5/06* (2013.01); *C10G 45/02* (2013.01); *C10G 45/58* (2013.01); *C10G 47/00* (2013.01); *C10G 49/00* (2013.01); *C10G 2300/1022* (2013.01); *C10G 2300/1033* (2013.01); *C10G 2300/302* (2013.01); *C10G 2300/4062* (2013.01)

(58) Field of Classification Search

CPC ..... C10G 2/32; C10G 2/333; C10G 47/00; C10G 2/344; C10G 2/341; C10G 45/58; C10G 49/00; C10G 2/332; C10G 45/02; C10G 5/06; C10G 2300/302; C10G 2300/1022; C10G 2300/1033; C10G 2300/4062

See application file for complete search history.

(56) References Cited

U.S. PATENT DOCUMENTS 7,837,853 B2 11/2010 Ansell et al.
2010/0282640 A1 * 11/2010 Rojey et al. ..... 208/49

OTHER PUBLICATIONS

U.S. Appl. No. 12/974,337, filed Dec. 21, 2010. (57 Pages).

*Primary Examiner* — Randy Boyer
*Assistant Examiner* — Juan Valencia
(74) *Attorney, Agent, or Firm* — Karen R. DiDomenicis

(57) ABSTRACT

A process and system are described for producing a synthetic crude oil by contacting a synthesis gas with a combination of a synthesis gas conversion catalyst and a hydroconversion catalyst in a synthesis gas reactor. The synthesis gas can be obtained from gas associated with crude oil production, i.e., associated gas, in a synthesis gas generator. The synthetic crude oil can be blended with a natural crude oil to produce a blended stabilized crude oil having 2 wt % or more of the synthetic crude oil. The resulting blended stabilized crude oil has improved flow characteristics including a pour point of 30° C. or less.

22 Claims, 5 Drawing Sheets

PROCESS AND SYSTEM FOR BLENDING SYNTHETIC AND NATURAL CRUDE OILS AND BLENDS MADE THEREBY

CROSS-REFERENCE TO RELATED APPLICATIONS

This application claims priority to U.S. Ser. No. 12/974,337, filed Dec. 21, 2010, which in turn claims priority to U.S. Ser. No. 61/291,639, filed Dec. 31, 2009, and is entitled Process and System for Blending Synthetic and Natural Crude Oils Derived from Offshore Produced Fluids.

FIELD OF THE INVENTION

The present invention relates generally to processes for converting natural gas to synthesis gas and further into synthetic crude oil, and more particularly, to the blending of the synthetic crude oil with natural crude oil produced from a subterranean reservoir.

BACKGROUND OF THE INVENTION

A stream of produced fluids containing hydrocarbon products produced from a subterranean reservoir contains several components that must be separated: a stabilized crude oil generally having a vapor pressure of 14.7 psia or less, condensate, liquefied petroleum gas (LPG) and methane. Condensate refers to a light hydrocarbon mixture that is separated from stabilized crude oil. It typically contains pentane, hexane, and can contain small amounts of butane. These more volatile condensates are often shipped separately from stabilized crude oil. LPG refers to propane, butane and mixtures thereof. In addition to these components, other components that are frequently separated are ethane and water. Further, contaminants such as sulfur and other non-carbon and non-hydrogen elements may also be separated out of the crude oil and gases. A significant amount of capital must be spent for facilities to separate hydrocarbon containing produced fluids into these components.

Heavy and/or waxy crude oils are found in many locations around the world, and are attractive for their low cost per barrel and impressive yield of high-value products. However, high pour points and challenging flow properties complicate the process of transporting these crudes from oilfield to refinery. While transportation by pipeline is usually the preferred method, most heavy crudes are extremely time and temperature-sensitive and must be transferred via insulated or heated tankers to prevent solidification. The addition of chemical pour point depressants or "lighter" petroleum products is a common method of improving flow characteristics of crude oils and thereby alleviating this problem.

Pour point is the lowest temperature at which a liquid will not flow, or the temperature at or below which the liquid loses its ability to flow. It is desirable to keep crude oil at least 11° C., and preferably 22° C., above its pour point during transportation and storage. The lowest sea temperatures are typically around 10° C. To avoid having to heat ships, lines, tanks and the like, crudes should have a pour point less than 30° C., depending on the part of the world.

Typically, the amount of methane or "associated gas" produced along with crude oil is insufficient to justify conversion to Liquefied Natural Gas (LNG). However options to handle associated gas are limited. Natural gas often cannot be burned (flared) due to increasingly stringent regulations around greenhouse gas emissions. Also, natural gas often typically is not reinjected into a producing formation as this dilutes the crude oil and leads to a loss in crude oil production. Local uses, such as combustion of the natural gas for facilities uses, are insufficient to consume this gas.

One technology currently used to handle associated gas that cannot be flared, reinjected or used in local markets is to convert the associated gas into synthetic fuels such as diesel, jet fuel, and naphtha by a Fischer-Tropsch process. Conventional Fischer-Tropsch processes make a waxy product that is subsequently converted via hydroconversion into premium quality transportation fuels. Gas conversion to these products via the Fischer-Tropsch process is well known such as is described in U.S. Pat. No. 7,479,216.

The conventional Fischer-Tropsch conversion process is an extremely exothermic and expensive process and when used on associated gas, facilities distinct from those for crude oil must be used to handle the premium Fischer-Tropsch diesel, jet fuel, condensate and other products. For oilfields with high gas/oil ratio (GOR), gas-to-liquids (GTL) conversion via Fischer Tropsch synthesis is economically unfavorable and may require more space and resources than are available. Likewise, the wax from the Fischer-Tropsch process has such a high melting point that the conventional Fischer-Tropsch product cannot be shipped in conventional crude tankers, but instead, requires expensive ships suitable for handling this high melting temperature material. As described in U.S. Pat. Appln. No. 2006/0069296, conventional crude tankers are often limited to material having pour points at or below 140° F. (60° C.).

Blending the wax from the Fischer-Tropsch process into crude oil is not an option either. Blending as little as 2 wt % of a conventional Fischer-Tropsch product into some crude oils may increase the pour point above 60° C. Also, conventional Fischer-Tropsch products contain substantial quantities of olefins, alcohols and acids. When blended with crude oil these Fischer-Tropsch products can cause the crude oil to be difficult to refine and may lead to a discount in the crude sale price.

There is a need for a low-cost process to convert associated gas from a stream of produced fluids produced from a subterranean formation into a low-impurity synthetic crude oil while avoiding the difficulties caused by wax content. There is a further need for such a process to convert associated gas to a synthetic crude oil that can be blended with natural crude oil, wherein a blended stabilized crude oil having a pour point at or below 30° C. is produced.

SUMMARY

The present invention relates to a process and system for producing a blended stabilized crude oil from a stream of produced fluids produced from a hydrocarbon containing subterranean reservoir. The process includes:

(a) converting synthesis gas in a conversion reactor, in the presence of a synthesis gas conversion catalyst and a hydroconversion catalyst, into a tail gas and a liquid effluent stream including liquefied petroleum gas and synthetic crude oil; and (b) sending at least a portion of the liquid effluent stream to a separator and separating the liquefied petroleum gas from the synthetic crude oil: and (c) producing a blended stabilized crude oil containing natural crude oil obtained from produced fluids produced from the hydrocarbon containing subterranean reservoir and the synthetic crude oil;

wherein the blended stabilized crude oil has a pour point at or below 30° C. and comprises at least 2 wt % of the synthetic crude oil.

The system includes:

(a) a separation complex used to separate a stream of produced fluids, including hydrocarbons components and water, received from a hydrocarbon containing subterranean reservoir into water, natural gas, liquefied petroleum gas and crude oil;

(b) a synthesis gas generator which converts the natural gas into synthesis gas; and (c) a conversion reactor which utilizes both a synthesis gas conversion catalyst and a hydroconversion catalyst to convert the synthesis gas into a tail gas and a liquid effluent stream which includes liquefied petroleum gas and synthetic crude oil;

wherein at least a portion of the liquid effluent stream can be fed to the separation complex and the liquefied petroleum gas is separated from the synthetic crude oil and liquefied petroleum gas is separated from natural crude oil with a blended stabilized crude oil being produced which includes natural crude oil and synthetic crude oil; and wherein the blended stabilized crude oil has a pour point at or below 30° C. and comprises at least 2 wt % of the synthetic crude oil.

According to yet another aspect, the present invention relates to a blended stabilized crude oil including a natural crude oil and at least 2 wt % of a synthetic crude oil; wherein the blended stabilized crude oil has a pour point less than the pour point of the natural crude oil.

BRIEF DESCRIPTION OF THE DRAWINGS

These and other objects, features and advantages of the present invention will become better understood with regard to the following description, pending claims and accompanying drawings where:

DETAILED DESCRIPTION OF THE INVENTION

Figure 1:
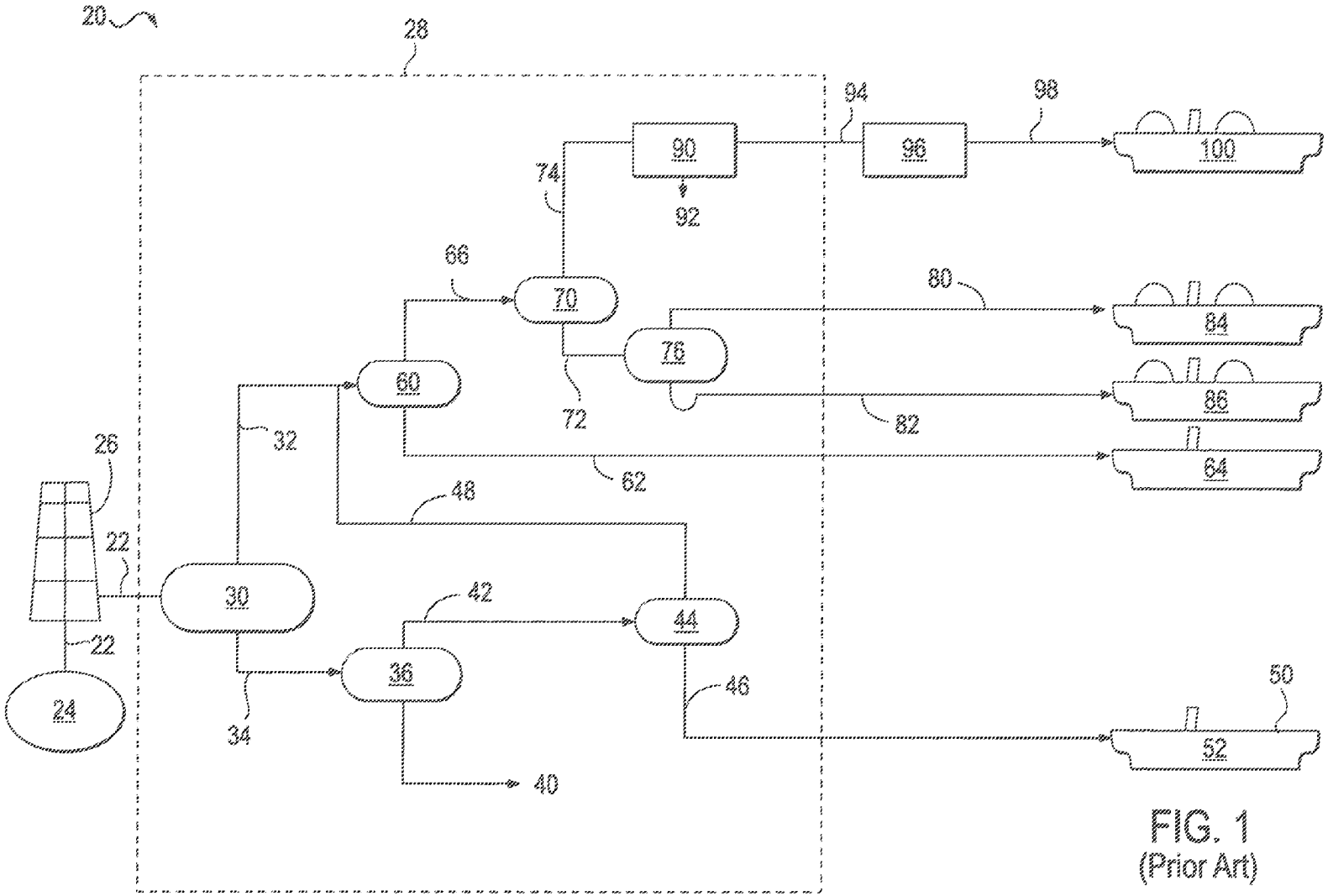
FIG. 1 (Prior Art)
FIG. 1 is a schematic of a conventional system for producing hydrocarbon containing produced fluids, separating the produced fluids into useful products and then transporting the separated products.

A low-cost process has been discovered to convert synthesis gas containing carbon monoxide and hydrogen into a low-impurity liquid synthetic crude product that can be sold as is or can be blended at an amount greater than 2 wt % with stabilized natural crude oil wherein the blended stabilized crude oil has a pour point at or below 30° C. and can be more efficiently transported, e.g., via pipeline or oil tanker. Preferably the liquid synthetic crude product is wax-free, containing less than 5 wt % $C_{21+}$ normal paraffins and water, In one embodiment, the process utilizes the following elements:

(a) a source of synthesis gas; and (b) a conversion reactor containing both a synthesis gas conversion catalyst and a hydroconversion catalyst which converts the synthesis gas into a tail gas and a low-impurity effluent stream comprising propane, butane, and synthetic crude oil and water.

The synthesis gas can be derived from any of a number of sources, including, but not limited to, natural gas, e.g. associated gas, shale gas and the like, coal, biomass, and landfill waste. Tail gas from a synthesis gas conversion reactor can also be the source of synthesis gas. In another embodiment, liquefied petroleum gas and condensate can be reformed to form synthesis gas. Technologies are available and are known to those skilled in the art for generation of synthesis gas from each of the sources.

In one embodiment, a low-cost process has been discovered to convert associated natural gas into a wax-free, low-impurity liquid synthetic crude product that can be sold as is or can be blended at an amount greater than 2 wt % with stabilized natural crude oil wherein the blended stabilized crude oil has a pour point at or below 30° C. and can be more efficiently transported, e.g., via pipeline or oil tanker. In this embodiment, the natural gas is separated from produced fluids produced from a hydrocarbon bearing reservoir, and is subsequently converted to the synthesis gas (syngas).

This process can utilize the following system elements:

(a) a separation complex which is used to separate the components in produced fluids into natural gas, liquefied petroleum gas (LPG) including propane and butane, and stabilized crude oil, and optionally condensate, water and sulfur compounds;

(b) a synthesis gas generator which converts the natural gas or other source as disclosed herein into synthesis gas; and (c) a conversion reactor containing both a synthesis gas conversion catalyst and a hydroconversion catalyst which converts synthesis gas into a tail gas and a low-impurity effluent stream comprising propane, butane, and synthetic crude oil.

In one embodiment, the effluent stream is fed to the separation complex, with or without water removed from the effluent stream, and is separated along with the components of the produced fluids into natural gas. LPG (propane, butane) and a blended stabilized crude oil. The blended stabilized crude comprises at least 2 wt % synthetic crude oil and has a pour point at or below 30° C.

The hydroconversion component in the conversion reactor reduces the pour point of the product from the synthesis gas conversion catalyst. This allows liquefied petroleum gases to be removed from the synthetic crude oil and from the natural crude oil so that a blended stabilized crude oil can be produced which has a pour point at or below 30° C. when the synthetic crude oil comprises 2 wt % more of the blended stabilized synthetic crude oil. The hydroconversion component reduces the pour point of the product from the synthesis gas conversion catalyst by one or more of hydrocracking, hydroisomerization, and hydrogenation and combinations thereof.

Costs can be reduced by use of the same separation complex to separate the components of the produced fluids, which include the natural crude oil, and the components of the effluent stream, which includes the synthetic crude oil, from the conversion reactor. Costs are also reduced by operating both synthetic gas conversion catalyst and the hydroconversion catalyst in the same conversion reactor. No separate hydroconversion unit is needed to hydrocrack the Fischer-Tropsch synthetic crude oil (syncrude) product before it is suitable for blending with the natural crude oil and transported. Natural crude oil as used herein refers to the crude oil physically separated from the production fluids obtained from a subterranean formation. Synthetic crude oil is made using the conversion reactor to convert synthesis gas into an effluent stream and tail gas. The synthetic crude oil refers to a hydrocarbonaceous material comprising at least 75 wt % material with carbon numbers of 5 or more. For example, the synthetic crude oil may contain 90 or 95 wt % of $C_{5+}$ components. Similarly, the natural crude oil refers to a hydrocarbonaceous material comprising at least 75 wt % material with carbon numbers of 5 or more. For example, the crude oil may contain 90 or 95 wt % of $C_{5+}$ components.

A separation complex is typically a group of equipment consisting of distillation towers, liquid-gas separators, pumps, and lines capable of separating the components in produced fluids into at least natural gas, liquefied petroleum gas (LPG), and stabilized crude oil. The LPG is preferably further separated and further processed into saleable butane and propane. Other optional products such as condensate, water and sulfur compounds may also be separated. A conversion reactor is a vessel comprising a synthesis gas conversion catalyst and a hydroconversion catalyst which converts synthesis gas into a low impurity effluent comprising propane, butane, and synthetic crude oil. The conversion reactor can be a multi-tubular fixed bed reactor, a microchannel reactor, a slurry bed reactor or a fluidized bed reactor. Synthesis gas conversion catalysts refer generally to Fischer Tropsch catalysts. Catalysts containing cobalt and ruthenium are preferred synthesis gas conversion catalyst for gas conversion to liquids because they exhibit little water-gas shift activity, and thus, low selectivity to carbon dioxide ($CO_2$). Hydroconversion refers to one or more of hydrocracking and hydroisomerization and hydrogenation reactions or combinations thereof. A hydroconversion catalyst preferably does not contain 10 ppm or more of sulfur as this is a poison for the synthesis gas conversion catalyst. The hydroconversion catalyst may comprise a metal and an acidic component. Examples, by way of example and not limitation, may include metals such as Fe, Co, Ni, Pd, Pt, Ir, Mo, and W. The noble metals are preferred. Nonlimiting examples of the acidic components are silica-aluminas, clays, and zeolites.

Typical conditions for conversions in a multi-tubular fixed bed reactor or in a fluid bed reactor include operating pressures of 1-100 atm, preferably 5-35 atm, most preferably 10-25 atm at temperatures of 175-260° C., more preferably 195-250° C. most preferably 215-235° C. The synthesis gas ratio of hydrogen to carbon monoxide ($H_2$:CO) in the reactor is typically in the range 1.0-2.0, feed to reactor about the usage ratio, 2.2, and space velocity GHSV=1000-2000 $h^{-1}$.

For most zeolites, the weight ratio of zeolite to cobalt is 10:1 to reliably produce substantially wax-free products at the extremes of low $H_2$/CO ratio (≤1.5), high pressure (>20 atm), and low temperature (<220° C.). The relative amount of zeolite can be lower (zeolite/Co=2:1 to 5:1 by weight) for operation at high $H_2$/CO ratio (2), low pressure (5-10 atm), and high temperature (230-240° C.).

"Low impurity" refers to a crude oil that contains less than 1 wt % oxygen as oxygenates, less than 10 wt % olefins, and with an acid number of 1.5 mg KOH or less as measured by ASTM D664; for example, oxygen less than 0.25 wt % and less than 0.1 wt %; for example, olefins less than 2 wt % and less than 0.5 wt %; for example, acid numbers of 0.5 mg KOH or less. A general discussion of acids numbers is described in U.S. Pat. No. 7,404,888, which is hereby incorporated in its entirety.

A condensate is a hydrocarbon mixture derived from crude oil and has a vapor pressure less than stabilized crude oil that is derived from the crude oil.

A stabilized crude oil is a hydrocarbonaceous mixture having a vapor pressure of 14.7 psia or less, for example 9-10 psia, according to ASTM test method D6377. See U.S. Pat. Appln. No. 2002/0128332. The volatility of crude oil in commercial tankers is typically limited to about 9 psia (pounds per square inch absolute) when measured at the shipping temperature. International maritime regulations limit the maximum Reid Vapor Pressure of crude oil carried aboard conventional tankers to "below atmospheric pressure" (i.e., less than 14.7 psia). These same regulations limit the closed cup flash point "not to exceed 60° C." (Safety of Life at Sea (SOLAS), Chapter 22, Regulation 55.1). A practical operational limit is a True Vapor Pressure, not Reid Vapor Pressure, of about 9-10 psia for conventional tankers. A True Vapor Pressure according to ASTM test method D2889 higher than approximately 10 or 11 psia during pumping will make it difficult, if not impossible, to fully discharge a tanker's cargo tanks, although the actual pumping performance will depend on the particular ship. Receiving shoreside terminals commonly have a maximum True Vapor Pressure limit of 11 psia, based on the maximum capability of floating roof storage tanks.

Description of an Exemplary Embodiment

FIG. 1 shows a conventional system 20 for processing and transporting produced fluids 22 produced from an offshore hydrocarbon producing well or reservoir 24. A wellhead 26 receives produced fluids 22 from reservoir 24 and sends the produced fluids 22 to a separation complex 28 located on an off-shore platform (not shown). Separation complex 28 receives the produced fluids 22, including gases and liquids, and separates the gases and liquids using a gas-liquid separator 30. As non-limiting examples, gas-liquid separator 30 may be a disengagement vessel or flash separator. Liquids 34 are sent to an optional water-crude oil separator 36 where water 40 is separated from unstabilized crude oil 42. Bulk water separation from crude oil may be carried out using an apparatus for gravity separation or a centrifuge. Standard oil field equipment may be used, e.g., a gravity settling/residence time tank, a horizontal skimmer, a free-water knockout tank or drum, a vertical separator, a gun barrel, or a heater treater. These are available from manufacturers such as Smith Industries, Inc. (Houston, Tex.) and C.E. Natco, Inc. (Tulsa, Okla.). Suitable centrifuges are available from manufacturers such as Alpha Laval Sharples (Houston, Tex.). Gravity settling or centrifuging for bulk separation will yield a crude oil suitable for removal of residual water. As another example, the separation process described in U.S. Pat. No. 6,007,702 may be used.

The unstabilized crude oil 42 is sent to a stabilizer 44 where it is stabilized into stabilized crude oil 46 by removing gases entrained in the crude oil 42. A conventional stabilizer includes a distillation column that heats the crude oil and removes the $C_{4-}$ fraction as an overhead stream. The stabilized crude is a bottom product. Gases 48, typically including liquefied petroleum gases, i.e. propane and butane, from stabilizer 44 are sent to a distiller 60. From separator complex 28 the stabilized crude oil 46 is sent to a crude oil tanker 50 and held in tanks 52 as a stabilized crude oil. The stabilized crude oil can then be transported to on-shore facilities (not shown) for further processing.

Gases 32 from gas-liquid separator 30 and gases 48 from stabilizer 44 are distilled in distiller 60 with a heavy condensate portion 62 being sent to condensate tanker 64 for transport. Lighter portions of the gases 66 are further distilled in a distiller into liquid petroleum gas (LPG) 72 and an even lighter portion 74 containing methane and ethane gases. The LPG gas 72 is distilled in a distiller 76 into valuable fractions of propane gas 80 and butane gas 82. Propane gas 80 is loaded into a propane carrier 84 and butane gas 82 is transported to a butane carrier 86. Although not shown, purification equipment may be needed for the propane and butane to make them salable. Depending on the crude oil, the propane and butane may contain mercaptans that need to be extracted.

Less valuable methane and ethane gases 74, if necessary, are sent to a separator 90, such as an amine extraction unit to have contaminants 92, such as hydrogen sulfide ($H_2S$), removed. A sweetened stream 94 of natural gas, including methane and ethane, are then sent to other facilities for further processing. In the example of FIG. 1, this facility may be a liquefaction plant 96 where the natural gas is liquefied into liquefied natural gas (LNG) 98. The LNG product 98 is loaded on to an LNG carrier 100 for transport to onshore ports or regasification facilities (not shown) or directly to market. Flaring of gases 74 is discouraged from an environmental point of view. In addition, there may be an excess of gases 74 such that not all of gases 74 can be burned in equipment requiring combusting for energy so some of gases 74 must be otherwise handled for transport.

Figure 2:
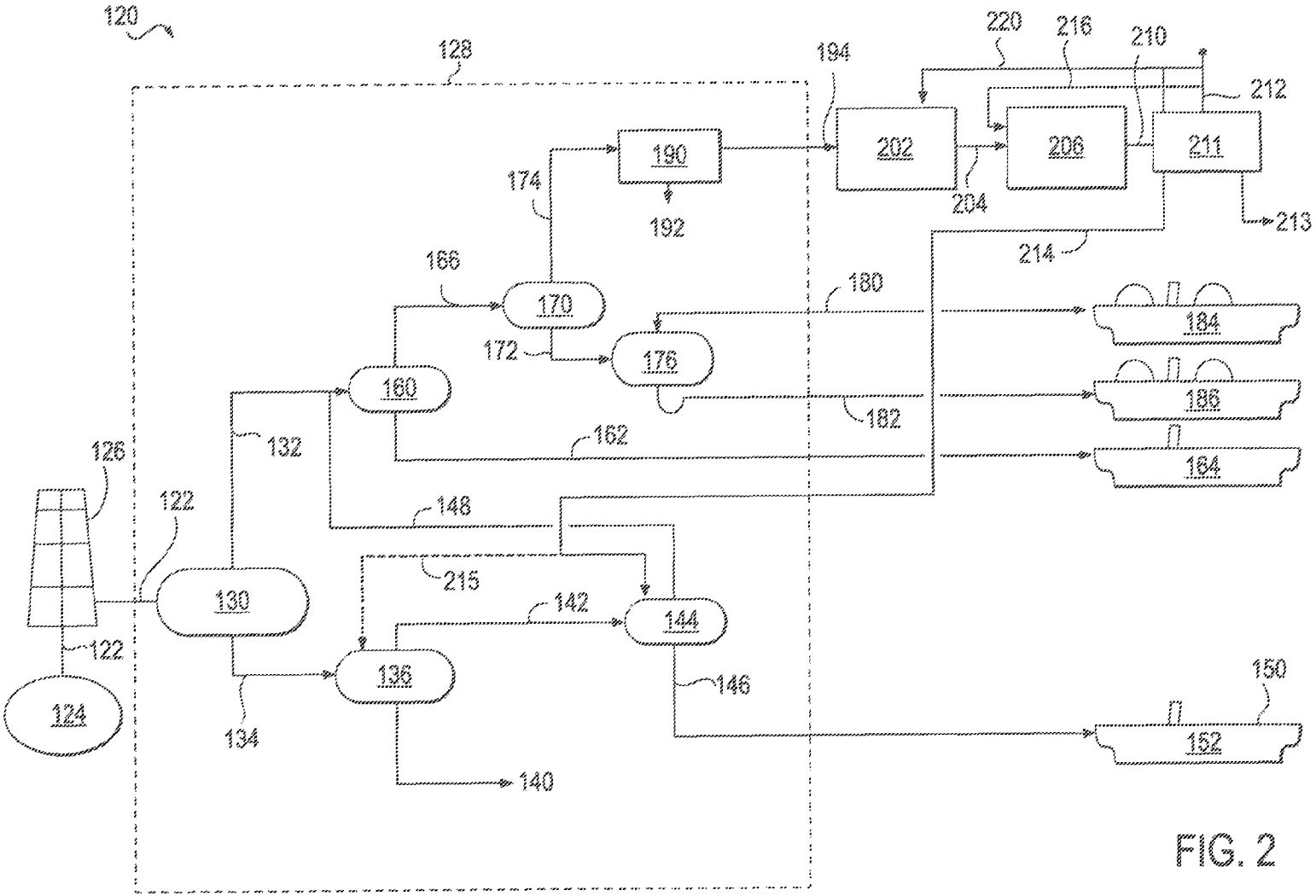
FIG. 2 is a schematic, similar to FIG. 1, of a novel system according to one embodiment wherein natural gas separated from produced fluids is converted into a synthetic crude oil and then the synthetic crude oil and natural crude oil have liquefied petroleum gases removed so that a combined blended crude oil is produced that is stabilized to have a suitable vapor pressure for shipping in a conventional crude oil tanker.

FIG. 2 shows an embodiment of the present invention wherein a separation complex 128 is used to process produced fluids 122 from a subterranean reservoir 124.

Components of complex 128 that are like those of complex 28 are identified with reference numerals incremented by 100.

Rather than use a liquefaction plant 96 to liquefy sweetened natural gas 194, natural gas 194 is converted in a synthetic gas generator 202 where the natural gas 194 is converted into synthesis gas 204. Synthesis gas 204 is then converted in a synthesis gas conversion reactor 206 into a pressurized and vaporized conversion product 210. After conversion product 210 exits conversion reactor 206, product 210 may be cooled in a condenser/separator 211 to 400° F. (204° C.), or more preferably 200° F. (93° C.), and also depressurized with a tail gas 212 coming off of product 210 and also providing a stream of water 213 and an effluent stream 214. The tail gas is recycled after cooling the effluent stream but preferably before any depressurization. This minimizes compression costs. This separation in condenser/separator 211 uses conventional separation equipment that is well known to those skilled in the art of Fischer-Tropsch conversion of synthesis gas. Alternatively, the liquefied hydrocarbon products and water could be sent to separation complex 128 for necessary separation into the desired end products. However, it is preferred that water is removed from the effluent stream prior to the effluent stream of hydrocarbons being sent to separation 128.

Tail gas 212 may be recycled back to conversion reactor 206 to increase the efficiency of the synthesis gas conversion. The tail gas 212 contains unreacted synthesis gas with light products from the conversion reactor 206 (typically methane, ethane, $CO_2$, and small amounts of uncondensed water). A portion 216 of tail gas 212 containing unconverted synthesis gas may be recycled to conversion reactor 210 to increase the conversion of the syngas to hydrocarbon products. In addition, a portion of the tail gas 212 may be recycled to synthesis gas generator 202 with portion 220 being used to control the $H_2$/CO ratio of the synthesis gas 204 output from syngas generator 202.

The effluent stream 214 from conversion reactor 206 is a mixture of pressurized liquid hydrocarbons with dissolved gases. Effluent stream 214 includes synthetic crude oil and gases such as propane and butane. Effluent stream 214 is sent to stabilizer 144 and decompressed to produce a portion of gas 148 that is routed to distiller 160. Again, although not preferred, if water from effluent stream 214 is not removed by condenser/separator 211, a water containing effluent stream 215, shown in dotted lines, may be sent to water/crude oil separator 136 (also referred to as a water/oil separator) with water being separated from the synthetic crude oil and with a stream 142 of blended crude oil of natural crude oil and synthetic crude being sent to stabilizer 144. Alternatively, the water containing effluent could be mixed directly with the produced fluids 122 and then separated with the produced fluids as described above with respect to FIG. 1. Gases 148 are removed from liquids in stabilizer 144 with $C_{4-}$ gases being sent to distiller 160. In one embodiment, no separation of a condensed $C_{5+}$ hydrocarbon phase from the synthetic crude oil is needed or conducted prior to blending the synthetic crude with the natural crude. A blended stabilized crude oil 146, derived from the degassed natural crude oil and synthetic crude oil, is then delivered to the tanks of crude oil tanker 150. The blended stabilized crude oil preferably has a pour point below 30° C. and contains at least 2 wt % of synthetic crude oil.

Again, effluent stream 214 may be routed to a number of locations in separations complex 128. If water is removed from effluent stream 214 prior to being sent to separations complex 128, then effluent stream 122 may be sent directly to stabilizer 144. If it is necessary to remove water from effluent stream 214, then effluent stream can be sent to water/crude separator 136 or even to gas/liquid separator 130.

The entrained gases from the synthetic crude oil are combined with gases separated from produced fluids 122 in separation complex 128. This process uses the same equipment handling two gas sources thus improving capital expense efficiency. In one embodiment, the $C_3$'s and $C_4$'s from both the produced fluids 122 and effluent stream 214, including the synthetic crude oil, are converted to specification propane and butane and sold as compressed liquefied gases. The methane and ethane from the produced fluids and from the effluent stream 214 are purified and fed to the gasification section of separation complex 128. A methanizer, which may be considered as part of synthesis gas generator 202, may use hydrogen gas and a nickel catalyst to convert the relatively small amounts of $C_{2+}$ in the gas mixture 194 to methane. The methane is then partially oxidized using $O_2$ to form synthesis gas in synthesis gas generator 202, which is then converted in the synthesis gas or conversion reactor 206. The $O_2$ is supplied by typical equipment (not shown), such as an air separation plant that works by liquefaction. Such methanizers and air separation plants are well known to those skilled in the art of air separation and synthesis gas conversion. Similarly, conversion of natural gas to synthesis gas is well known to those skilled in Fischer-Tropsch conversion of natural gas to waxy liquid products.

The $C_{5+}$ products from the natural crude oil 142 and effluent stream 214 are combined to make a stabilized blended crude oil with a vapor pressure of less than 14.7 psia, preferably less than 5 psia. If there is a large amount of $C_5$-$C_6$ relative to the $C_{7+}$ fraction, a separate condensate stream may be produced. See U.S. Pat. No. 6,541,524 for more details on crude vapor pressure regulations.

In one embodiment, effluent stream 214 encounters no hydroconversion downstream of conversion reactor 206. A significant advantage of the present process and system as a consequence of the low $C_{21+}$ normal paraffin production in the syngas conversion is that no further hydroconversion is required in order to achieve a desired product distribution. When the process is carried out offshore, obviating the need for stored hydrogen and hydroconversion equipment is particularly desirable. Furthermore, in one embodiment, the system does not include an oil/wax separator for separating wax from the synthetic crude oil.

Synthesis of Effluent Streams Containing Synthetic Crude Oil

Details are now described of various embodiments for producing effluent stream containing the synthetic crude oil with the entrained LPG and other gases. Synthesis gas conversion catalysts are used to convert the synthesis gas into higher chains of hydrocarbons, preferably largely in the liquid range $C_5$-$C_{21}$ and limited in alkane waxes, i.e. $C_{21+}$. Preferably, the synthetic crude oil contains less than 5 wt % $C_{21+}$. The hydroconversion catalysts operate on the product produced from the synthesis gas conversion catalyst by one or more of (1) limiting chain growth through hydrocracking to limit $C_{21+}$ from forming; (2) hydroisomerizing the product to increase branching and limiting the formation of solid waxes in the effluent stream 214; and (3) hydrogenating the product to limit olefin content. Preferably, the synthetic crude oil is a "low impurity product." That is, the synthetic crude oil has less than 1 wt % oxygen as oxygenates, less than 10 wt % olefins, and with an acid number of 1.5 mg KOH or less as measured by ASTM D664. More preferably, the synthetic crude oil contains less than 0.25 wt % oxygen as oxygenates, less than 2 wt % olefins, and with an acid number of 0.5 mg KOH or less, and even more preferably will contain less than 0.1 wt % oxygen as oxygenates, less than 0.5 wt % olefins, and with an acid number of 0.5 mg KOH or less. Described below are three examples of how the catalysts may be made and arranged in conversion reactor 206.

1. Integral Catalyst

U.S. patent application Ser. No. 12/343,534, entitled Zeolite Supported Cobalt Hybrid Fischer-Tropsch Catalyst, describes an integral catalyst that be used in a single bed in conversion reactor 206 to convert synthesis gas to a product including synthetic crude oil. The contents of this disclosure are hereby incorporated by reference in its entirety.

Impregnation methods followed by reduction-oxidation-reduction activation are employed for making a practical hybrid Fischer-Tropsch catalyst. Cobalt-ruthenium/zeolite catalysts with high activities for synthesis gas conversion to hydrocarbon liquids have been prepared using commercially available, alumina bound zeolite extrudates. With cobalt nitrate, metal loading in a single step impregnation is limited to about 6-7 wt % cobalt for these alumina bound zeolites. Thus, multiple impregnations are often needed, with intervening drying and calcination treatments to disperse and decompose the metal salts. The cobalt content was varied from 5 wt % to 15 wt %. Usually, calcination in air produced materials with lower activities than those that were formed by direct reduction of cobalt nitrate. However, direct reduction on a large scale is considered to be undesirable since it is very exothermic and it produces a pyrophoric catalyst that must then be passivated before it can be handled in air. A low temperature reduction-oxidation-reduction cycle has been found superior to a single reduction step for the activation of cobalt-ruthenium/zeolite catalysts for synthesis gas conversion.

Use of zeolite extrudates has been found to be beneficial, for the relatively larger zeolite extrudate particles will cause less pressure drop within a reactor and be subject to less attrition than zeolite powder or even granular zeolite (e.g., having a particle size of about 300-1000 microns). Formation of particles from zeolite powder or granular zeolite plus Co/alumina and a binder, to be sized equivalent to zeolite extrudate (i.e., to avoid pressure drop and attrition) would result in blinding of cobalt sites and would probably still result in some ion exchange during the required drying and calcination steps, thus lowering the activity and selectivity of the resultant catalyst.

Methods of formation of zeolite extrudates are readily known to those of ordinary skill in the art. Wide variations in macroporosity are possible with such extrudates. For the present application, without wishing to be bound by any theories, it is believed that as high a macroporosity as possible, consistent with high enough crush strength to enable operation in long reactor tubes, will be advantageous in minimizing diffusion constraints on activity and selectivity. The zeolite-mediated Fischer-Tropsch synthesis is not as diffusion-limited as that of normal Fischer-Tropsch synthesis, since the pores of the presently disclosed zeolite supported Fischer-Tropsch catalyst stay open during operation, whereas the pores of a normal Fischer-Tropsch catalyst fill with oil (melted wax).

In extrudate formation, strength is produced in a calcination step at high temperature. The temperature is high enough to cause solid state reactions between cobalt oxides and alumina or aluminosilicate portions of the material, to form very stable, essentially non-reducible phases such as spinels. Consequently, it is vital that the metal be added after the extrudate has been formed and has already undergone calcination.

As used herein, the phrase "hybrid Fischer-Tropsch catalyst" refers to a Fischer-Tropsch catalyst comprising a Fischer-Tropsch base component as well as a component containing the appropriate functionality to convert in a single-stage the primary Fischer-Tropsch products into desired products (i.e., minimize the amount of heavier, undesirable products). For example, the combination of a Fischer-Tropsch component displaying high selectivity to sort-chain α-olefins and oxygenates with zeolite(s) results in an enhanced naphtha and diesel selectivity. In one embodiment in particular, in a single-stage Fischer-Tropsch reaction, the presently disclosed hybrid Fischer-Tropsch catalyst provides:

0-20, for example, 5-15 or 8-12, weight % $CH_4$;
0-20, for example, 5-15 or 8-12, weight % $C_2$-$C_4$;
50-95, for example, 60-90 or 75-80, weight % $C_{5+}$; and
0-5 weight % $C_{2+}$.

As used herein, the phrase "zeolite supported cobalt catalyst" refers to catalyst wherein the cobalt metal is distributed as small crystallites upon the zeolite support. The cobalt content of the zeolite supported cobalt catalyst can depend on the alumina content of the zeolite. For example, for an alumina content of about 20 weight % to about 99 weight % based upon support weight, the catalyst can contain, for example, from about 1 to about 20 weight % cobalt, preferably 5 to about 15 weight % cobalt, based on total catalyst weight, at the lowest alumina content. At the highest alumina content the catalyst can contain, for example, from about 5 to about 30 weight % cobalt, preferably from about 10 to about 25 weight % cobalt, based on total catalyst weight.

It has been found that synthesis gas comprising hydrogen and carbon monoxide can be selectively converted under synthesis gas conversion conditions to liquid hydrocarbons with a catalyst prepared by subjecting a zeolite supported cobalt catalyst to an activation procedure comprising the steps, in sequence, of (A) reduction in hydrogen, (B) oxidation in an oxygen-containing gas, and (C) reduction in hydrogen, the activation procedure being conducted at a temperature below 500° C. It has been found that the activation procedure of the present disclosure provides zeolite supported cobalt catalyst with improved reaction rates when the catalyst is prepared by impregnation of a zeolite support with cobalt. Moreover, the activation procedure of the present disclosure can significantly improve activity of promoted, zeolite supported cobalt catalyst, wherein a promoter such as, for example, Ru, Rh, Pd, Cu, Ag, Au, Zn, Cd, Hg, and/or Re has been previously added to improve activity. The catalyst of the present disclosure is produced by subjecting a zeolite supported cobalt catalyst to an activation procedure including the steps of (i) reduction, (ii) oxidation, and (iii) reduction, herein termed "ROR activation" while under a temperature below 500° C., for example, below 450° C. By subjecting the zeolite supported cobalt catalyst to ROR activation, the activity of the resultant catalyst can be increased by as much as about 100% using the activation procedure of the present disclosure.

Molecular sieves are crystalline materials that have regular passages (pores). If examined over several unit cells of the structure, the pores will form an axis based on the same units in the repeating crystalline structure. While the overall path of the pore will be aligned with the pore axis, within a unit cell, the pore may diverge from the axis, and it may expand in size (to form cages) or narrow. The axis of the pore is frequently parallel with one of the axes of the crystal. The narrowest position along a pore is the pore mouth. The pore size refers to the size of the pore mouth. The pore size is calculated by counting the number of tetrahedral positions that form the perimeter of the pore mouth. A pore that has 10 tetrahedral positions in its pore mouth is commonly called a 10-ring pore. Pores of relevance to catalysis in this application have pore sizes of 8 rings or greater. If a molecular sieve has only one type of relevant pore with an axis in the same orientation to the crystal structure, it is called 1-dimensional. Molecular sieves may have pores of different structures or may have pores with the same structure but oriented in more than one axis related to the crystal. In these cases, the dimensionality of the molecular sieve is determined by summing the number of relevant pores with the same structure but different axes with the number of relevant pores of different shape.

Exemplary zeolite supports of the present disclosure include, but are not limited to, amorphous silica-alumina, tungstated zirconia, zeolitic crystalline medium pore molecular sieves, non-zeolitic crystalline medium pore molecular sieves, zeolitic crystalline large and extra-large pore molecular sieves, non-zeolitic crystalline large and extra-large pore molecular sieves, mesoporous molecular sieves and zeolite analogs. A zeolite is a molecular sieve that contains silica in the tetrahedral framework positions. Examples include, but are not limited to, silica-only (silicates), silica-alumina (aluminosilicates), silica-boron (borosilicates), silica-germanium (germanosilicates), alumina-germanium, silica-gallium (gallosilicates) and silica-titania (titanosilicates), and mixtures thereof.

Small pore molecular sieves are defined herein as those having 8 membered rings; medium pore molecular sieves are defined as those having 10 membered rings; large pore molecular sieves are defined as those having 12 membered rings; extra-large molecular sieves are defined as those having 14+ membered rings.

Mesoporous molecular sieves are defined herein as those having average pore diameters between 2 and 50 nm. Representative examples include the M41 class of materials, e.g. MCM-41, in addition to materials known as SBA-15, TUD-1, HMM-33, and FSM-16.

Exemplary supports of the hybrid synthesis gas conversion catalyst include, but are not limited to, those medium pore molecular sieves designated EU-1, ferrierite, heulandite, clinoptilolite, ZSM-11, ZSM-5, ZSM-57, ZSM-23, ZSM-48, MCM-22, NU-87, SSZ-44, SSZ-58. SSZ-35, SSZ-57, SSZ-74, SUZ-4, Theta-1, TNU-9, IM-5 (IMF), ITQ-13 (ITH), ITQ-34 (ITR), and silicoaluminophosphates designated SAPO-11 (AEL) and SAPO-41 (AFO). The three letter designation is the name assigned by the IUPAC Commission on Zeolite Nomenclature.

Exemplary supports of the hybrid synthesis gas conversion catalyst include, but are not limited to, those large pore molecular sieves designated Beta, CIT-1, Faujasite, Linde Type L, Mordenite, ZSM-10 (MOZ), ZSM-12, ZSM-18 (MEI), MCM-68, gmelinite (GME), cancrinite (CAN), mazzite/omega (MAZ), SSZ-37 (NES), SSZ-41 (VET), SSZ-42 (IFR), SSZ-48, SSZ-60, SSZ-65 (SSF), ITQ-22 (IWW), ITQ-24 (IWR), ITQ-26 (IWS), ITQ-27 (IWV), and silicoaluminophosphates designated SAPO-5 (AFI), SAPO-40 (AFR), SAPO-31 (ATO), SAPO-36 (ATS) and SSZ-51 (SFO).

Exemplary supports of the hybrid synthesis gas conversion catalyst include, but are not limited to, those extra-large pore molecular sieves designated CIT-5, UTD-1 (DON), SSZ-53, SSZ-59, and silicoaluminophosphate VPI-5 (VFI).

For convenience, supports for the hybrid synthesis gas conversion catalyst may be herein referred to as "zeolite supports" although it should be understood that this encompasses the above non-zeolitic materials as well as zeolitic materials.

A promoter, such as ruthenium or the like may be included in the catalyst of the present disclosure if desired. For a catalyst containing about 10 weight % cobalt, the amount of ruthenium can be from about 0.01 to about 0.50 weight %, for example, from about 0.05 to about 0.25 weight % based upon total catalyst weight. The amount of ruthenium would accordingly be proportionately higher or lower for higher or lower cobalt levels, respectively. A catalyst level of about 10 weight % cobalt has been found to best for 80 weight % ZSM-5 and 20 weight % alumina. The amount of cobalt can be increased as amount of alumina increases, up to about 20 weight % Co.

The ROR activation procedure of the present disclosure may be used to improve activity of the zeolite supported catalyst of the present disclosure. Any technique well known to those having ordinary skill in the art to distend the catalytic metals in a uniform manner on the catalyst zeolite support is suitable, assuming they do not promote ion exchange with zeolite acid sites.

The method employed to deposit the catalytic metals of the present disclosure onto the zeolite support can involve an impregnation technique using a substantially non-aqueous solution containing soluble cobalt salt and, if desired, a soluble promoter metal salt, e.g., ruthenium salt, in order to achieve the necessary metal loading and distribution required to provide a highly selective and active catalyst.

Initially, the zeolite support can be treated by oxidative calcination at a temperature in the range of from about 450° to about 900° C., for example, from about 600° to about 750° C. to remove water and any organics from the zeolite support.

Meanwhile, a non-aqueous organic solvent solution of a cobalt compound, e.g., salt, and, if desired, an aqueous or non-aqueous organic solvent solution of ruthenium compound, e.g., salt, for example, are prepared. Any suitable ruthenium salt, such as ruthenium nitrate, chloride, acetate or the like can be used. Aqueous solutions for the promoters can be used in very small amounts. As used herein, the phrase "substantially non-aqueous" refers to a solution that includes at least 95 volume % non-aqueous solution. In general, any metal compounds, e.g. metal salt, which is soluble in the organic solvent of the present disclosure and will not have a poisonous effect on the catalyst can be utilized.

The non-aqueous organic solvent is a non-acidic liquid which is formed from moieties selected from the group consisting of carbon, oxygen, hydrogen and nitrogen, and possesses a relative volatility of at least 0.1. The phrase "relative volatility" refers to the ratio of the vapor pressure of the solvent to the vapor pressure of acetone, as reference, when measured at 25° C.

Suitable solvents include, for example, ketones, such as acetone, butanone (methyl ethyl ketone); the lower alcohols, e.g., methanol, ethanol, propanol and the like; amides, such as dimethyl formamide; amines, such as butylamine; ethers, such as diethylether and tetrahydrofuran; hydrocarbons, such as pentane and hexane; and mixtures of the foregoing solvents. In an embodiment, the solvents are acetone, for cobalt nitrate or tetrahydrofuran.

Suitable cobalt compounds include, for example, cobalt nitrate, cobalt acetate, cobalt carbonyl, cobalt acetylacetonate, or the like. Likewise, any suitable ruthenium salt, such as ruthenium nitrate, chloride, acetate or the like can be used. In an embodiment, ruthenium acetylacetonate is used. In general, any metal salt which is soluble in the organic solvent of the present disclosure and will not have a poisonous effect on the metal catalyst or on the acid sites of the zeolite can be utilized.

The calcined zeolite support is then impregnated in a dehydrated state with the substantially non-aqueous, organic solvent solution of the metal compounds. Thus, the calcined zeolite support should not be unduly exposed to atmospheric humidity so as to become rehydrated.

Any suitable impregnation technique can be employed including techniques well known to those skilled in the art so as to distend the catalytic metals in a uniform thin layer on the catalyst zeolite support. For example, the cobalt along with the oxide promoter can be deposited on the zeolite support material by the "incipient wetness" technique. Such technique is well known and requires that the volume of substantially non-aqueous solution be predetermined so as to provide the minimum volume which will just wet the entire surface of the zeolite support, with no excess liquid. Alternatively, the excess solution technique can be utilized if desired. If the excess solution technique is utilized, then the excess solvent present, e.g., acetone, is merely removed by evaporation.

Next, the substantially non-aqueous solution and zeolite support are stirred while evaporating the solvent at a temperature of from about 25° to about 50° C. until "dryness."

The impregnated catalyst is slowly dried at a temperature of from about 110° to about 120° C. for a period of about 1 hour so as to spread the metals over the entire zeolite support. The drying step is conducted at a very slow rate in air.

The dried catalyst may be reduced directly in hydrogen or it may be calcined first. In the case of impregnation with cobalt nitrate, direct reduction can yield a higher cobalt metal dispersion and synthesis activity, but reduction of nitrates is difficult to control and calcination before reduction is safer for large scale preparations. Also, a single calcination step to decompose nitrates is simpler if multiple impregnations are needed to provide the desired metal loading. Reduction in hydrogen requires a prior purge with inert gas, a subsequent purge with inert gas and a passivation step in addition to the reduction itself, as described later as part of the ROR activation. However, impregnation of cobalt carbonyl must be carried out in a dry, oxygen-free atmosphere and it must be decomposed directly, then passivated, if the benefits of its lower oxidation state are to be maintained.

The dried catalyst is calcined by heating slowly in flowing air, for example 10 cc/gram/minute, to a temperature in the range of from about 200° to about 350° C., for example, from about 250° to about 300° C., that is sufficient to decompose the metal salts and fix the metals. The aforesaid drying and calcination steps can be done separately or can be combined. However, calcination should be conducted by using a slow heating rate of, for example, 0.5° to about 3° C. per minute or from about 0.5° to about 1° C. per minute and the catalyst should be held at the maximum temperature for a period of about 1 to about 20 hours, for example, for about 2 hours.

The foregoing impregnation steps are repeated with additional substantially non-aqueous solutions in order to obtain the desired metal loading. Ruthenium and other promoter metal oxides are conveniently added together with cobalt, but they may be added in other impregnation steps, separately or in combination, either before, after, or between impregnations of cobalt.

After the last impregnation sequence, the loaded catalyst zeolite support is then subjected to the ROR activation treatment of the present disclosure. The ROR activation treatment of the present disclosure must be conducted at a temperature considerably below 500° C. in order to achieve the desired increase in activity and selectivity of the cobalt-impregnated catalyst. Temperatures of 500° C. or above reduce activity and liquid hydrocarbon selectivity of the cobalt-impregnated catalyst. Suitable ROR activation temperatures are below 500° C., preferably below 450° C. and most preferably, at or below 400° C. Thus, ranges of 100° or 150° to 450° C., for example, 250° to 400° C. are suitable for the reduction steps. The oxidation step should be limited to 200° to 300° C. These activation steps are conducted while heating at a rate of from about 0.1 to about 5° C. for example, from about 0.1° to about 2° C.

The impregnated catalyst can be slowly reduced in the presence of hydrogen. If the catalyst has been calcined after each impregnation, to decompose nitrates or other salts, then the reduction may be performed in one step, after an inert gas purge, with heating in a single temperature ramp (e.g., 1° C./min.) to the maximum temperature and held at that temperature, from about 250° or 300° to about 450° C., for example, from about 350° to about 400° C., for a hold time of 6 to about 65 hours, for example, from about 16 to about 24 hours. Pure hydrogen is preferred in the first reduction step. If nitrates are still present, the reduction is best conducted in two steps wherein the first reduction heating step is carried out at a slow heating rate of no more than about 5° C. per minute, for example, from about 0.1 to about 1° C. per minute up to a maximum hold temperature of 200° to about 30° C., for example, 200° to about 250° C., for a hold time of from about 6 to about 24 hours, for example, from about 16 to about 24 hours under ambient pressure conditions. In the second treating step of the first reduction, the catalyst can be heated at from about 0.5° to about 3° C. per minute, for example, from about 0.1° to about 1° C. per minute to a maximum hold temperature of from about 250° or 300° up to about 450° C., for example, from about 350° to about 400° C. for a hold time of 6 to about 65 hours, for example, from about 16 to about 24 hours. Although pure hydrogen is preferred for these reduction steps, a mixture of hydrogen and nitrogen can be utilized.

Thus, the reduction may involve the use of a mixture of hydrogen and nitrogen at 100° C. for about one hour; increasing the temperature 0.5° C. per minute until a temperature of 200° C.; holding that temperature for approximately 30 minutes; and then increasing the temperature 1° C. per minute until a temperature of 350° C. is reached and then continuing the reduction for approximately 16 hours. Reduction should be conducted slowly enough and the flow of the reducing gas maintained high enough to maintain the partial pressure of water in the offgas below 1%, so as to avoid excessive steaming of the exit end of the catalyst bed. Before and after all reductions, the catalyst must be purged in an inert gas such as nitrogen, argon or helium.

The reduced catalyst is passivated at ambient temperature (25°-35° C.) by flowing diluted air over the catalyst slowly enough so that a controlled exotherm of no larger than +50° C. passes through the catalyst bed. After passivation, the catalyst is heated slowly in diluted air to a temperature of from about 300° to about 350° C. (preferably 300° C.) in the same manner as previously described in connection with calcination of the catalyst.

The temperature of the exotherm during the oxidation step should be less than 100° C., and will be 50-60° C. if the flow rate and/or the oxygen concentration are dilute enough. If it is even less, the oxygen is so dilute that an excessively long time will be needed to accomplish the oxidation. There is a danger in exceeding 300° C. locally, since cobalt oxides interact with alumina and silica at temperatures above 400° C. to make unreducible spinels, and above 500° C., Ru makes volatile, highly toxic oxides.

Next, the reoxidized catalyst is then slowly reduced again in the presence of hydrogen, in the same manner as previously described in connection with the initial reduction of the impregnated catalyst. This second reduction is much easier than the first. Since nitrates are no longer present, this reduction may be accomplished in a single temperature ramp and held, as described above for reduction of calcined catalysts.

The composite catalyst of the present disclosure has an average particle diameter, which depends upon the type of reactor to be utilized, of from about 0.01 to about 6 millimeters; for example, from about 1 to about 6 millimeters for a fixed bed; and for example, from about 0.01 to about 0.11 millimeters for a reactor with the catalyst suspended by gas, liquid, or gas-liquid media (e.g., fluidized beds, slurries, or ebullating beds).

The charge stock used in the process of the present disclosure is a mixture of CO and hydrogen. Any suitable source of the CO and hydrogen can be used. The charge stock can be obtained, for example, by (i) the oxidation of coal or other forms of carbon with scrubbing or other forms of purification to yield the desired mixture of CO and $H_2$ or (ii) the reforming of natural gas. $CO_2$ is not a desirable component of the charge stocks for use in the process of the present disclosure, but it may be present as a diluent gas. Sulfur compounds in any form are deleterious to the life of the catalyst and should be removed from the CO—$H_2$ mixture and from any diluent gases.

The reaction temperature is suitably from about 160° to about 280° C., for example, from about 175° to about 250° C. or from about 185° to about 235° C. The total pressure is, for example, from about 1 to about 100 atmospheres, for example, from about 3 to about 35 atmospheres or from about 5 to about 20 atmospheres. It has been found that the use of pressures of at least 50 psi (3.4 atmospheres) using the low ruthenium catalysts of the present disclosure results in activities greater than that achievable with larger quantities of ruthenium at the same pressure.

The gaseous hourly space velocity based upon the total amount of feed is less than 20,000 volumes of gas per volume of catalyst per hour, for example, from about 100 to about 5000 v/v/hour or from about 1000 to about 2500 v/v/hour. If desired, pure synthesis gas can be employed or, alternatively, an inert diluent, such as nitrogen, $CO_2$, methane, steam or the like can be added. The phrase "inert diluent" indicates that the diluent is non-reactive under the reaction conditions or is a normal reaction product.

The synthesis gas reaction using the catalysts of the present disclosure can occur in a fixed, fluid or moving bed type of operation. The conversion reactor can be a multi-tubular fixed bed reactor, a microchannel reactor, a slurry bed reactor or a fluidized bed reactor. For specific examples of catalyst which have been made and products produced, see U.S. patent application Ser. No. 12/343,534. Microchannel reactors contain a plurality of process microchannels containing catalyst adjacent heat exchange zones. The proximity of the heat exchange zones to the microchannels facilitates the removal of heat from the exothermic process within the microchannels. Catalyst can be applied to the interior of the microchannels by any known means, e.g., spray coating, dip coating, etc. An example of a suitable microchannel reactor is given in U.S. Pat. No. 7,084,180.

U.S. patent application Ser. No. 12/797,439, entitled Zeolite Supported Ruthenium Catalysts for the Conversion of Synthesis Gas to Hydrocarbons, and Method for Preparation and Method of Use Thereof, describes another integral catalyst that be used in a single bed in conversion reactor 206 to convert synthesis gas to a product including synthetic crude oil. The contents of this disclosure are hereby incorporated by reference in its entirety.

A method for forming a catalyst for synthesis gas conversion is described. The method comprises impregnating a zeolite extrudate using a solution comprising a ruthenium compound to provide an impregnated zeolite extrudate and activating the impregnated zeolite extrudate by a reduction-oxidation-reduction cycle ("ROR activation"). In an embodiment, the supported ruthenium catalyst was prepared by the method of aqueous impregnation and vacuum drying, followed by calcinations. Ruthenium alone, usually known as a promoter for cobalt, is a Fischer-Tropsch active metal that provides surprisingly low $C_{1-4}$ products from conversion of natural gas derived synthesis gases.

Ruthenium/zeolite catalysts with high activities for synthesis gas conversion to hydrocarbon liquids have been prepared using commercially available, alumina bound zeolite extrudates, e.g., ZSM-5, ZSM-12, SSZ-32 or beta zeolite. With ruthenium nitrate based compounds such as ruthenium nitrosyl nitrate, metal loading in a single step impregnation is limited to about 6 to 7 weight % ruthenium, even about 0.5 to 5 weight % for these alumina bound zeolites. Multiple impregnations may be needed, with intervening drying and calcination treatments to disperse and decompose the metal salts. The total ruthenium content can be varied from 0.1 weight % to 15 weight %. Calcination in air produces materials with lower activities than those formed by direct reduction of the ruthenium nitrate based compound. However, direct reduction on a large scale is considered to be undesirable since it is very exothermic and it produces a pyrophoric catalyst that must then be passivated before it can be handled in air. A low temperature reduction-oxidation-reduction cycle, described below in further detail, may be preferable to a single reduction step for the activation of ruthenium/zeolite catalysts for synthesis gas conversion.

In one embodiment, in a single-stage reaction, the presently disclosed process provides:

0-20 for example, 1-15 or 4-14, weight % $CH_4$;

0-30 for example, 5-30 or 6-16, weight % $C_2$-$C_4$;

50-95, for example, 65-90 or 70-90, weight % $C_{5+}$; and 0-5 weight % $C_{21+}$.

As used herein, the phrase "zeolite supported ruthenium catalyst" refers to a hybrid catalyst wherein the ruthenium metal is distributed as small crystallites upon the zeolite support. The ruthenium content of the zeolite supported ruthenium catalyst can depend on the alumina content of the zeolite. For example, for an alumina content of about 20 weight % to about 99 weight % based upon support weight, the catalyst can contain, for example, from about 1 to about 20 weight % ruthenium, even from about 1 to about 5 weight % ruthenium, based on total catalyst weight, at the lowest alumina content. At the highest alumina content the catalyst can contain, for example, from about 1 to about 20 weight % ruthenium, even from about 2 to about 10 weight % ruthenium, based on total catalyst weight.

It has been found that synthesis gas comprising hydrogen and carbon monoxide can be selectively converted under synthesis gas conversion conditions to liquid hydrocarbons with a catalyst prepared by subjecting a zeolite supported ruthenium catalyst to an ROR activation procedure comprising the steps, in sequence, of (A) reduction in hydrogen, (B) oxidation in an oxygen-containing gas, and (C) reduction in hydrogen, the activation procedure being conducted at a temperature below 500° C. It has been found that the activation procedure of the present disclosure provides zeolite supported ruthenium catalyst with improved reaction rates when the catalyst is prepared by impregnation of a zeolite support with ruthenium.

Optionally, Re, Rh, Pt, Pd, Ag, Au, Mn, Zn, Cd, Hg, Cu, Pr or other rare earth metals can be added as a promoter to improve the activity of the zeolite supported ruthenium catalyst. Higher loadings of Ru without a promoter favor gasoline range products. Rhenium (Re) is a promoter which favors diesel range products. As an example, for a catalyst containing about 3 weight % ruthenium, the amount of rhenium promoter can be from about 0.1 to about 1 weight %, for example, from about 0.05 to about 0.5 weight % based upon total catalyst weight. The amount of rhenium would accordingly be proportionately higher or lower for higher or lower ruthenium levels, respectively. Catalyst levels of about 3 weight % have been found to best for 80 weight % ZSM-5 and 20 weight % alumina. The amount of ruthenium can be increased as amount of alumina increases, up to about 6 weight % Ru.

Suitable catalysts have from 0.8 to 1.2 weight % Ru and a support selected from the group consisting of ZSM-5 or beta zeolite with from 0.0 to 0.7 weight % Re. A catalyst with 1.5 to 2.5 weight % Ru and a ZSM-5 support without Re produces more hydrocarbons in the gasoline range than diesel range while still having less than 1 weight % above $C_{21+}$.

Exemplary zeolite supports of the present disclosure include those which are fairly acidic Brönsted acids having Si to Al ratios of about 10 to 100. Examples are SSZ-26, SSZ-33, SSZ-46, SSZ-53, SSZ-55, SSZ-57, SSZ-58, SSZ-59, SSZ-64, ZSM-5, ZSM-11, ZSM-12, MTT (e.g., SSZ-32, ZSM-23 and the like), H-Y, BEA (zeolite Beta), SSZ-60 and SSZ-70. Preferred supports are ZSM-5, Beta, and SSZ-26. These molecular sieves each contain silicon as the major tetrahedral element, have 8 to 12 ring pores, and are microporous molecular sieves, meaning having pore mouths of 20 rings or less.

Initially, the zeolite support can be treated by oxidative calcination at a temperature in the range of from about 450° to about 900° C., for example, from about 600° to about 750° C. to remove water and any organics from the zeolite support.

The method employed to deposit the catalytic metals of the present disclosure onto the zeolite support can involve an impregnation technique using a solution containing soluble ruthenium compound or salt and, if desired, a soluble promoter metal salt which will not have a poisonous effect on the catalyst e.g., for example, rhenium salt, in order to achieve the necessary metal loading and distribution required to provide a highly selective and active catalyst. Any suitable ruthenium salt, such as ruthenium nitrate, chloride, acetate or the like can be used. Aqueous solutions for the promoters can be used in very small amounts. Nonaqueous solutions can also be used.

Suitable nonaqueous solvents include, for example, ketones, such as acetone, butanone (methyl ethyl ketone); the lower alcohols, e.g., methanol, ethanol, propanol and the like; amides, such as dimethyl formamide; amines, such as butylamine; ethers, such as diethylether and tetrahydrofuran; hydrocarbons, such as pentane and hexane; and mixtures of the foregoing solvents. In an embodiment, the solvents are acetone, for ruthenium nitrate or tetrahydrofuran.

Suitable ruthenium salts include, for example, ruthenium nitrosyl nitrate, ruthenium acetate, ruthenium carbonyl, ruthenium acetylacetonate, or the like. Other Ru +3, +4, +6, +7, and +8 known compounds may be used. In one embodiment, ruthenium acetylacetonate is used.

The calcined zeolite support is then impregnated in a dehydrated state with the solution of the metal salts so as to distend the catalytic metal in a uniform thin layer on the catalyst zeolite support. Thus, the calcined zeolite support should not be unduly exposed to atmospheric humidity so as to become rehydrated.

Next, the solution and zeolite support are stirred while evaporating the solvent at a temperature of from about 25° to about 85° C. until "dryness."

As described above in the preparation of the cobalt-ruthenium integral catalyst, the impregnated catalyst is then slowly dried in air, followed by reduction-oxidation-reduction treatment.

The resulting catalyst has an average particle diameter of from about 1 to about 6 millimeters.

The charge stock used in the process of the present disclosure is a mixture of CO and hydrogen. The ratio of hydrogen to carbon monoxide is between about 0.5 and about 2.5, preferably between about 1 and about 2.

The reaction temperature is suitably from about 160° to about 300° C., for example, from about 175° to about 280° C. or from about 185° to about 275° C. The total pressure is, for example, from about 1 to about 100 atmospheres, for example, from about 3 to about 35 atmospheres or from about 5 to about 30 atmospheres. The gaseous hourly space velocity based upon the total amount of feed is less than 20,000 volumes of gas per volume of catalyst per hour, for example, from about 100 to about 5000 v/v/hour or from about 1000 to about 2500 v/v/hour.

U.S. Ser. No. 12/953,024, entitled Ruthenium Hybrid Fischer-Tropsch Catalyst, and Methods for Preparation and Use Thereof, discloses yet another integral catalyst suitable for use in the conversion reactor 206. The contents of this disclosure are hereby incorporated by reference in its entirety into the present application. A method for forming a hybrid Fischer-Tropsch catalyst for synthesis gas conversion is described. A ruthenium compound is deposited onto a porous solid metal oxide support to provide ruthenium loaded particles. The ruthenium loaded particles are combined with zeolite particles and a binder material. The resulting mixture is then extruded to give a shaped catalyst body, also referred to as an extrudate, containing ruthenium loaded particles and zeolite particles in a binder matrix.

The Fischer-Tropsch functionality of the catalyst is provided by ruthenium loaded particles which can be formed by any known means for depositing a ruthenium compound onto a solid metal oxide support, including, but not limited to, precipitation, impregnation and the like. Any technique known to those having ordinary skill in the art to distend the ruthenium in a uniform manner on the support is suitable. Suitable support materials include porous solid metal oxides such as alumina, silica, titania, magnesia, zirconia, chromia, thoria, boria and mixtures thereof.

Initially, the metal oxide support can be treated by oxidative calcination at a temperature in the range of from about 450° C. to about 900° C., for example, from about 600° C. to about 750° C. to remove water and any organics from the metal oxide structure.

According to one embodiment, the method employed to deposit the ruthenium onto the metal oxide support involves an impregnation technique using an aqueous or nonaqueous solution containing a soluble ruthenium compound such as, for example, a salt and, if desired, a soluble promoter metal, in order to achieve the necessary metal loading and distribution required to provide a highly selective and active catalyst. Suitable ruthenium compounds include, for example, ruthenium nitrosyl nitrate, ruthenium acetate, ruthenium carbonyl, ruthenium acetylacetonate, ruthenium chloride or the like. Other $Ru^{+3, +6, +7, and +8}$ known compounds may be used.

Suitable solvents include, for example, water; ketones, such as acetone, butanone (methyl ethyl ketone); the lower alcohols, e.g., methanol, ethanol, propanol and the like; amides, such as dimethyl formamide; amines, such as butylamine; ethers, such as diethylether and tetrahydrofuran; hydrocarbons, such as pentane and hexane; and mixtures of the foregoing solvents. In an embodiment, the solvents are acetone, for ruthenium nitrate or tetrahydrofuran.

As described in previous embodiments of the integral catalyst, the calcined metal oxide support is then impregnated using any suitable impregnation technique in a dehydrated state with the aqueous solution of the metal compound(s). Thus, the calcined zeolite support should not be unduly exposed to atmospheric humidity so as to become rehydrated. If the incipient wetness technique is used, the solution and metal oxide support are stirred while evaporating the solvent at a temperature of from about 25° C. to about 85° C. until "dryness."

As previously described, the impregnated catalyst can be dried slowly in air and may be calcined in order to form stable metal-oxygen bonds.

Using the above described impregnation method, ruthenium crystallites having a diameter of between about 1 nm and 20 nm are formed on the support. With ruthenium nitrate based compounds such as ruthenium nitrosyl nitrate, metal loading in a single step impregnation is limited to up to about 7 weight % ruthenium and preferably 0.5 to 5 weight % for typical alumina supports. For the purposes of illustration, Fischer-Tropsch component levels of about 3 weight % have been found suitable for use in a hybrid Fischer-Tropsch catalyst containing 80 weight % ZSM-5 and 20 weight % alumina. Multiple impregnations may be needed, with alternating drying and low temperature (i.e., less than 300° C.) calcination treatments to disperse and decompose the ruthenium compounds. After drying, the ruthenium crystallites are effectively immobilized on the support.

The ruthenium loaded support optionally includes metal promoters where desired to improve the activity. Suitable promoters include iron (Fe), cobalt (Co), molybdenum (Mo), manganese (Mn), praseodymium (Pr), rhodium (Rh), platinum (Pt), palladium (Pd), copper (Cu), silver (Ag), gold (Au), zinc (Zn), cadmium (Cd), rhenium (Rh), nickel (Ni), potassium (K), chromium (Cr), zirconia (Zr), cerium (Ce) and niobium oxide. Rhenium is a promoter which favors diesel range products. Higher loadings of Ru without a promoter favor gasoline range products. In one embodiment, for a catalyst containing about 3 weight % ruthenium, the amount of rhenium can be from about 0.1 to about 1 weight %, for example, from about 0.05 to about 0.5 weight % based upon total catalyst weight. The amount of rhenium would accordingly be selected to be proportionately higher or lower for higher or lower ruthenium levels, respectively. The amount of ruthenium can be increased as the amount of alumina increases, up to about 15 weight % Ru. The ruthenium loaded support particles are then mixed with an acidic component in powder form along with a binder material and extruded to form, after drying, a shaped catalyst body or extrudate.

The weight ratio of acidic component to the ruthenium component, i.e., the weight ratio of active components, can be between 1:1 and 600:1. The weights of the acidic component and the ruthenium component are intended herein to include the weight of the active catalyst material as well as any optional metal promoters, but not the weight of any binder materials. If the ratio is below this range, the resulting product may undesirably contain solid wax. If the ratio is above this range, the product may be undesirably light and productivity may be low. In one embodiment, the weight ratio of acidic component to the ruthenium component is between 2:1 and 100:1; in another embodiment, the ratio is between 10:1 and 100:1; in yet another embodiment, the ratio is between 20:1 and 100:1; in yet another embodiment, the ratio is between 30:1 and 100:1.

The acidic component for use in the catalyst can be selected, by way of example and not limitation, from any of the materials previously listed for use in the integral catalyst.

The acidic component can have an external surface area of between about 10 $m^2/g$ and about 300 $m^2/g$, a porosity of between about 30 and 80%, and a crush strength of between about 1.25 and 5 lb/mm. Si/Al ratio for the acidic component can be 10 or greater, for example, between about 10 and 100.

The acidic component can optionally include a promoter selected from the group consisting of platinum, ruthenium, nickel, copper, rhodium, rhenium, palladium, silver, osmium, iridium, cobalt, gold, molybdenum, tungsten, and oxides and combinations thereof.

Suitable binder materials include, for example, sols of alumina, silica, titania, magnesia, zirconia, chromia, thoria, boria, beryllia and mixtures thereof.

By forming the extrudate to include separate particles of ruthenium loaded support and acidic component, all of the ruthenium is kept outside the acidic component channels, e.g., the channels within the zeolite.

The ruthenium loaded support, the acidic component and the binder sol are mixed by any convenient means. The mixture may be conditioned by adding water or aging the mixture to form an extrudable mass. The mixture is then extruded by forcing the mass through a die and cutting the extruded mass to the desired length using any particular method known to those of ordinary skill in the art. In one embodiment, the extrudate catalyst body is dried at a temperature of 110° C. to 130° C.

The dried catalyst may be reduced directly in hydrogen or it may be calcined first. In extrudate formation, strength is produced in a calcination step at high temperature. The calcination temperature should be high enough to cause solid state reactions between the binder and metal oxide support, to form very stable metal-oxygen bonds. The dried catalyst is calcined by heating slowly in flowing air, for example 10 cc/gram/minute, to a temperature in the range of from about 200° C. to about 500° C. The aforesaid drying and calcination steps can be done separately or can be combined. However, calcination should be conducted by using a slow heating rate of, for example, 0.5° C. to about 3° C. per minute or from about 0.5° C. to about 1° C. per minute and the catalyst should be held at the maximum temperature for a period of about 1 to about 20 hours, for example, for about 2 hours.

The extrudate is finally activated by one of a single reduction step, reduction-oxidation, or reduction-oxidation-reduction cycle.

In one embodiment, the resulting catalyst extrudate has a ruthenium content of from 0.1 weight % to 15 weight %; in another embodiment, the extrudate has a ruthenium content of from 0.3 to 3 weight %. The ruthenium content of the final hybrid catalyst extrudate depends on the amounts of the content of other components which dilute the total ruthenium content, i.e., metal oxide support, zeolite and binder materials used, as the total of all of the weight percentages of the catalyst components is 100%. For example, for an alumina binder content of at least about 20 weight % and a zeolite content of at least about 20 weight % based upon the weight of the final hybrid catalyst extrudate, the catalyst can contain from 0.1 weight % to 5 weight % ruthenium, preferably 0.2 to 2 weight % ruthenium, based on total catalyst weight, at the lowest content of ruthenium and metal oxide support. At the highest content of ruthenium and metal oxide support, the catalyst can contain, for example, from about 1 to about 15 weight % ruthenium, preferably from about 0.2 to about 2 weight % ruthenium, based on the weight of the final hybrid catalyst extrudate.

In one embodiment, no cobalt compounds are added during the catalyst preparation and the extrudate is essentially free of cobalt. By essentially free of cobalt is meant that the extrudate contains less than 0.1 weight percent cobalt.

In one embodiment, the hybrid Fischer-Tropsch catalyst extrudate has an average particle diameter, which depends upon the type of reactor to be utilized, of from about 0.01 to about 6 mm; for example, from about 1 to about 6 mm for a fixed bed; and for example, from about 0.01 to about 0.11 mm for a reactor with the catalyst suspended by gas, liquid, or gas-liquid media (e.g., fluidized beds, slurries, or ebullating beds). Particle diameter can be determined using any means known to one skilled in the art, including, but not limited to, sieving or screening, observing the rate of sedimentation, observation via microscopy, etc. For the purposes of the present invention, particle diameter is determined by sieving. The catalyst can be applied in conventional multi-tubular, fixed bed reactors in various known process configurations, including recycle operation of a single reactor, series operation of several reactors, dry gas recycle, hydrocarbon liquid recycle, etc.

In one embodiment, the hybrid Fischer-Tropsch catalyst extrudate has a pore volume between about 0.2 and about 0.5 $cm^3$ per gram. In one embodiment, the hybrid Fischer-Tropsch catalyst has a BET surface area between about 150 and about 500 $m^2$ per gram. In one embodiment, the hybrid Fischer-Tropsch catalyst extrudate has an acidity between about 300 and about 800 μmol per gram.

Use of the extruded hybrid Fischer-Tropsch catalyst extrudates disclosed herein has been found to be beneficial as the relatively larger extrudate particles avoid high pressure drop within a syngas conversion reactor and are subject to less attrition than zeolite powder or even granular zeolite (e.g., having a particle size of about 300-1000 μm).

The hybrid Fischer-Tropsch catalyst extrudate can be used in a process for performing a synthesis gas conversion reaction such as previously described using other embodiments of the integral catalyst.

The combination of a ruthenium-based Fischer-Tropsch component with an acidic component (e.g., zeolite) results in enhanced selectivity for desirable products, i.e., low $CH_4$ levels, high $C_{5+}$ levels and low $C_{21+}$ n-paraffins. The branched nature of the carbon chain products make them beneficial for transportation fuels having low temperature pour, cloud or freeze points. Waxy products formed on the ruthenium component are cracked (i.e., by the acidic component) into mainly branched hydrocarbons with limited formation of aromatics. In one embodiment, in a single-stage Fischer-Tropsch reaction, the presently disclosed hybrid Fischer-Tropsch catalyst extrudate provides the following product at ambient conditions:

1-15 weight % $CH_4$;
1-15 weight % $C_2$-$C_4$;
70-95, weight % $C_{5+}$;
0-5 weight % $C_{21+}$ normal paraffins; and
0-10, or even 0-5, weight % aromatic hydrocarbons.

In one embodiment, the hydrocarbon mixture produced is substantially free of solid wax by which is meant that the product is a single liquid phase at ambient conditions without the visibly cloudy presence of an insoluble solid wax phase. According to this embodiment, the hydrocarbon mixture produced contains 0-5 weight % $C_{21+}$+ normal paraffins at ambient conditions. Liquid hydrocarbons produced by the present process advantageously have a cloud point as determined by ASTM D 2500-09 of 15° C. or less, even 10° C. or less, even 5° C. or less, and even as low as 2° C.

2. Stacked Bed Catalysts

U.S. Ser. No. 12/780,672, entitled Process of Synthesis Gas Conversion to Liquid Hydrocarbons using Synthesis Gas Conversion Catalyst and Hydroisomerization Catalyst, discloses a stacked bed arrangement of catalysts that be used in conversion reactor 206. The contents of this disclosure are hereby incorporated by reference in its entirety into the present application.

A process is disclosed for the synthesis of liquid hydrocarbons in the distillate fuel and/or lube base oil range from synthesis gas in a single multi-tubular fixed bed reactor. Within a fixed bed reactor, multiple, small-diameter tubes are enclosed in a common cooling medium, e.g., steam or water. Provided within the process is a method for synthesizing a mixture of olefinic and paraffinic hydrocarbons by contacting the synthesis gas with a synthesis gas conversion catalyst in a first, upstream catalyst bed. The terms "Fischer-Tropsch wax" and "$C_{21+}$ wax" are also used herein interchangeably to refer to $C_{21+}$ normal paraffins. The hydrocarbon mixture is then contacted within the same reactor downstream of the first catalyst bed with a second, downstream catalyst bed. The downstream bed can include a hydrogenation catalyst for hydrogenating olefins and a catalyst for hydroisomerizing the straight chain hydrocarbons. The upstream bed performs synthesis gas conversion while the downstream bed performs hydroisomerization and optional hydrocracking. The synthesis gas conversion and the subsequent hydroisomerization are carried out in a single reactor under essentially common reaction conditions without having to provide a separate reactor for hydroisomerization and optional hydrocracking. By "essentially common reaction conditions" is meant that the temperature of the cooling medium within the reactor is constant from one point to another within a few degrees Celsius (e.g., 0-3° C.) and the pressure within the reactor is allowed to equilibrate between the two beds. The temperatures and pressures of the upstream and downstream beds can differ somewhat, although advantageously it is not necessary to separately control the temperature and pressure of the two beds. The bed temperatures will depend on the relative exotherms of the reactions proceeding within them. Exotherms generated by synthesis gas conversion are greater than those generated by hydrocracking; therefore in the case of constant reactor tube diameter, the average upstream bed temperature will generally be higher than the average downstream bed temperature. The temperature of the two beds can be made more equal by increasing the tube diameter in the second, downstream bed. The temperature difference between the beds will depend on various reactor design factors, including, but not limited to, the type and temperature of the cooling medium, the diameter of the tubes in the reactor, the rate of gas flow through the reactor, and so forth. For adequate thermal control, the temperatures of the two beds are preferably maintained within about 10° C. of the cooling medium temperature, and therefore the difference in temperature between the upstream and downstream beds is preferably less than about 20° C., even less than about 10° C. The pressure at the end of the upstream bed is equal to the pressure at the beginning of the downstream bed since the two beds are open to one another. Note that there will be a pressure drop from the top of the upstream bed to the bottom of the downstream bed because gas is being forced through narrow tubes within the reactor. The pressure drop across the reactor could be as high as about 50 psi (3 atm), therefore the average difference in pressure between the beds could be up to about 25 psi.

The upstream and downstream catalyst beds are arranged in series, in a stacked bed configuration. A feed of synthesis gas is introduced to the reactor via an inlet. The ratio of hydrogen to carbon monoxide of the feed gas is generally high enough that productivity and carbon utilization are not negatively impacted by not adding hydrogen in addition to the hydrogen of the syngas into the reactor or producing additional hydrogen using water-gas shift. The ratio of hydrogen to carbon monoxide of the feed gas is also generally below a level at which excessive methane would be produced. Advantageously, the ratio of hydrogen to carbon monoxide is between about 1.0 and about 2.2, even between about 1.5 and about 2.2. It is usually advantageous to operate the syngas conversion process in a partial conversion mode, 50-60% based on CO, and to condense the liquid products, especially water, before either recycling the dry tail gas or sending it to an additional reactor stage. The conversion rate drops rapidly as the partial pressures of the reactants decrease, and the water produced can damage the catalyst if its pressure gets too high. Therefore recycling the tail gas and/or staging permits operation at a low average $H_2$/CO ratio in the reactor, minimizing methane formation while allowing hydrogen to be used at a high ratio (e.g., at least 2.1) to form paraffinic products.

The feed gas initially contacts a synthesis gas conversion catalyst in the upstream bed of the reactor.

According to one embodiment, the upstream bed contains a conventional Fischer-Tropsch synthesis gas conversion catalyst. The Fischer-Tropsch synthesis gas conversion catalyst can be any known Fischer-Tropsch synthesis catalyst. Fischer-Tropsch catalysts are typically based on group VIII metals such as, for example, iron, cobalt, nickel and ruthenium. Catalysts having low water gas shift activity and suitable for lower temperature reactions, such as cobalt, are preferred. The synthesis gas conversion catalyst can be supported on any suitable support, such as solid oxides, including but not limited to alumina, silica or titania or mixtures thereof. As nonlimiting examples, the synthesis gas conversion catalyst can be present on the support in an amount of between 5% and 50% by weight in the case of cobalt, and between 0.01% and 1% by weight in the case of ruthenium.

According to another embodiment, the upstream bed contains a hybrid synthesis gas conversion catalyst. A hybrid synthesis gas conversion catalyst contains a synthesis gas conversion catalyst in combination with an olefin isomerization catalyst, for example a relatively acidic zeolite, for isomerizing double bonds in $C_{4+}$ olefins as they are formed. Methods for preparing a hybrid catalyst of this type have been described above in section 1 with regards to the integral catalyst.

According to yet another embodiment, the upstream bed contains a mixture of conventional Fischer-Tropsch catalyst and a hybrid synthesis gas conversion catalyst, wherein the bed contains between about 1 and about 99 weight % conventional Fischer-Tropsch catalyst and about 1 and about 99 weight % hybrid synthesis gas conversion catalyst, based on total catalyst weight.

The downstream catalyst bed contains a hydroisomerization catalyst for hydroisomerizing straight chain hydrocarbons. The hydroisomerization catalyst is a bifunctional catalyst containing a hydrogenation component comprising a metal promoter and an acidic component. The hydroisomerization catalyst can be selected from 10-ring and larger zeolites. Suitable materials for use as the hydroisomerization catalyst include, as not limiting examples, SSZ-32, ZSM-57. ZSM-48, ZSM-22, ZSM-23, SAPO-11 and Theta-1. The hydroisomerization catalysts can also be non-zeolitic materials.

According to one embodiment, the downstream catalyst bed also contains a hydrocracking catalyst for cracking straight chain hydrocarbons. The hydrocracking catalyst is an acid catalyst material. Suitable hydrocracking catalysts include any of the previously listed suitable materials for use as the zeolite support in the integral catalyst as described above in section 1.

As is well known, hydrocracking and hydroisomerization catalysts can optionally contain a metal promoter and a cracking component. The metal promoter is typically a metal or combination of metals selected from Group VIII noble and non-noble metals and Group VIB metals. Noble metals which can be used include platinum, palladium, rhodium, ruthenium, osmium, silver, gold and iridium. Non-noble metals which might be used include molybdenum, tungsten, nickel, cobalt, copper, rhenium, etc. Note that these are generally unsuitable for use in a fixed bed reactor system using recycle or in all except the final reactor in a staged fixed bed reactor system, since they usually have to be sulfided in order to avoid hydrogenolysis reactions that form methane and Fischer-Tropsch catalysts are susceptible to sulfur poisoning.

The metal promoter can be incorporated into the catalyst mixture by any one of numerous procedures. It can be added either to the cracking component, to the support or a combination of both. In the alternative, the Group VIII components can be added to the cracking component or matrix component by co-mulling, impregnation, or ion exchange and the Group VI components, i.e., molybdenum and tungsten can be combined with the refractory oxide by impregnation, co-mulling or co-precipitation. These components are usually added as a metal salt which can be thermally converted to the corresponding oxide in an oxidizing atmosphere or reduced to the metal with hydrogen or other reducing agent.

According to one embodiment, the downstream catalyst bed contains a combination of a hydroisomerization component, e.g. a noble metal-promoted zeolite of the SSZ-32 family and a solid acid hydrocracking component, e.g. Pd/ZSM-5. The proportion of cracking and hydroisomerization catalysts in the downstream bed is advantageously optimized to balance the isomerization activity with the cracking activity. If there is excessive cracking catalyst the resulting product may be lighter than desired. The cracking catalyst converts the n-paraffin wax product to a suitable chain length while the hydroisomerization component isomerizes the n-paraffin product, resulting in an entirely liquid isomerized product. If the desire is to produce a heavier, diesel range product, then the catalyst combination should exhibit less cracking and more isomerization. By including Pd/SSZ-32, for example, it has been found that more isomerization can be achieved. If there is insufficient cracking catalyst the hydroisomerization catalyst may be unable to convert the wax to liquid products under the mild process conditions of the present process. Accordingly, it may be advantageous to include in the downstream bed a combination of both a cracking catalyst component and a hydroisomerization catalyst in the correct proportions so as to obtain a desired product, e.g. having an average molecular weight in the diesel range, i.e. $C_{11}$ to $C_{20}$, and containing no solid wax phase at ambient conditions.

The amounts of hydrocracking and hydroisomerization catalysts in the downstream bed can be suitably varied to obtain the desired product. If the catalyst mixture amount is too low, there will be insufficient cracking and/or isomerization to convert all of the wax: whereas if there is too much catalyst mixture in the downstream bed, the resulting product may be too light. The amount of catalyst mixture needed in the downstream bed will in part depend on the tendency of the synthesis gas conversion catalyst in the upstream bed to produce wax and will in part depend on process conditions. In general, the weight of the catalyst mixture in the downstream bed is between about 0.5 and about 2.5 times the weight of the catalyst in the upstream bed.

The reaction temperature is suitably from about 160° C. to about 280° C., for example, from about 175° C. to about 250° C. or from about 185° C. to about 235° C. Higher reaction temperatures favor lighter products. The total pressure is, for example, from about 1 to about 100 atmospheres, for example, from about 3 to about 35 atmospheres or from about 5 to about 20 atmospheres. Higher reaction pressures favor heavier products. The gaseous hourly space velocity based upon the total amount of feed is less than 20,000 volumes of gas per volume of catalyst per hour, for example, from about 100 to about 5000 v/v/hour or from about 1000 to about 2500 v/v/hour.

Fixed bed reactor systems have been developed for carrying out the Fischer-Tropsch reaction. Such reactors are suitable for use in the present process. For example, suitable Fischer-Tropsch reactor systems include multi-tubular fixed bed reactors the tubes of which are loaded with the upstream and downstream catalyst beds. The process can also be carried out in a microchannel reactor, a slurry bed reactor or a fluidized bed reactor.

The present process provides for a high yield of paraffinic hydrocarbons in the middle distillate and/or light base-oil range under essentially the same reaction conditions as the synthesis gas conversion. The hydrocarbons produced are liquid at about 0° C. The hydrocarbons produced are substantially free of solid wax by which is meant that the product is a single liquid phase at ambient conditions without the visibly cloudy presence of an insoluble solid wax phase. By "ambient conditions" is meant a temperature of 15° C. and a pressure of 1 atmosphere. In one embodiment, the process provides a product having the following composition:

0-20, for example, 5-15 or 8-12, weight % $CH_4$;
0-20, for example, 5-15 or 8-12, weight % $C_2$-$C_4$;
60-95, for example, 70-90 or 76-84, weight % $C_{5+}$; and
0-5 weight % $C_{21+}$ normal paraffins.

In a typical Fischer-Tropsch process, the product obtained is a predominantly a normal or linear paraffin product, meaning free of branching. If the $C_{21+}$ fraction present within a predominantly linear product is greater than 5 weight %, the product has been found to contain a separate, visible solid wax phase. Products of the present process may actually contain $C_{21+}$ at greater than 5 weight % without a visible solid wax phase. This is believed to be because of the hydroisomerization capability of the hydroisomerization catalyst. Branched paraffins have lower melting points compared with normal or linear paraffins such that products of the present process can contain a greater percentage of $C_{21+}$ fraction and still remain a liquid which is free of a separate, visible solid wax phase at ambient conditions. The present process provides a product having a concentration of isomerized (i.e., containing at least single branches) $C_{21+}$ paraffin of at least 30 weight % based on the weight of the $C_{2+}$ fraction (as determined by gas chromatography). The result is a product which is liquid and pourable at ambient conditions. Liquid hydrocarbons produced by the present process have a cloud point as determined by ASTM D 2500-09 of 15° C. or less, even 10° C. or less, even 5° C. or less, and even as low as 2° C.

In addition, the present process provides for a high yield of paraffinic hydrocarbons in the middle distillate and/or light base-oil range without the need for separation of products arising from the first catalyst bed and without the need for a second reactor containing catalyst for hydrocracking and/or hydroisomerization. Process water arising from the first catalyst bed is not required to be separated from the reactor during the hydroisomerization of said $C_{21+}$ normal paraffins. It has been found that with a proper combination of catalyst composition, catalyst bed placement and reaction conditions, both the synthesis gas conversion reaction and the subsequent hydrocracking and/or hydroisomerization reactions can be conducted within a single reactor under essentially common process conditions.

While it is not required, under certain circumstances it may be desirable to run the present process with the addition of makeup hydrogen, with separation of products arising from the first catalyst bed, and/or using a second reactor for further hydrocracking and/or hydroisomerization.

An additional advantage to the present process is that undesired methane selectivity is kept low as a result of maintaining the process temperature in the lower end of the optimum range for Fischer-Tropsch synthesis and considerably lower than what is generally believed required for adequate hydrocracking and hydroisomerization activity. For specific examples of catalysts which have been made and products produced, see U.S. patent application Ser. No. 12/780,672.

3. Mixed Bed Catalysts

U.S. patent Ser. No. 12/621,385, entitled Process of Synthesis Gas Conversion to Liquid Fuels Using Mixture of Synthesis Gas Conversion Catalyst and Dual Functionality Catalyst, describes a mixed bed arrangement of catalysts that can be used in conversion reactor 206. The contents of this disclosure are hereby incorporated herein by reference in its entirety.

A process is disclosed for the synthesis of liquid hydrocarbons in the distillate fuel and/or lube base oil range from synthesis gas in a single multi-tubular fixed bed reactor. The process can also be carried out in a microchannel reactor, a slurry bed reactor or a fluidized bed reactor. Provided within the process is a method for synthesizing a mixture of olefinic and paraffinic hydrocarbons by contacting the synthesis gas with a mixture of a plurality of synthesis gas conversion catalyst particles including cobalt supported on a support containing an acidic component and a plurality of dual functionality catalyst particles including a hydrogenation component and a solid acid component. The two pluralities of particles are combined in a bed in which the two pluralities of particles are mixed uniformly, meaning there is no segregation between the two pluralities of particles. Within the bed, the hydrocarbon chains do not build up into the wax range ($C_{21+}$ normal paraffins). The presence of the noble metal promoted zeolite has been found to prevent the hydrocarbon chain from growing into the wax range.

Advantageously, a thin layer at the bottom of the catalyst bed (1-2% by volume) can be free of synthesis gas conversion catalyst, so that any wax formed contacts a hydrocracking catalyst.

The hydrocarbon mixture so formed can range from methane to light wax, and may include linear, branched and cyclic compounds. The synthesis gas conversion is carried out in a single reactor under essentially common reaction conditions without having to provide a separate reactor for hydrocracking and hydroisomerization.

A feed of synthesis gas is introduced to the reactor via an inlet. Advantageously, the ratio of hydrogen to carbon monoxide is between about 1 and about 2. If desired, pure synthesis gas can be employed or, alternatively, an inert diluent, such as nitrogen, $CO_2$, methane, steam or the like can be added.

The synthesis gas conversion catalyst contains cobalt which advantageously has low water gas shift activity and is suitable for lower temperature reactions. The synthesis gas conversion catalyst can be supported on any suitable binder, such as solid oxides, including but not limited to alumina, silica or titania, further containing an acidic component. A portion of the cobalt resides on the binder.

The acidic component can be, for example a relatively acidic zeolite, for isomerizing double bonds in $C_4^+$ olefins as they are formed. Methods for preparing a catalyst of this type are described in co-pending U.S. patent application Ser. No. 12/343,534, as described in section 1 above.

The synthesis gas conversion catalyst can include a promoter selected from ruthenium, rhenium, platinum, palladium, iridium, osmium, rhodium, gold, silver, and any suitable group IIIB or IVB metal oxide. Such promoters are disclosed in South African Patent Application No. 855317.

When a ruthenium promoter is used, the reduction-oxidation-reduction cycle used to activate the catalyst includes a first reduction step at a temperature in a range of about 200° to about 350° C. in order to avoid formation of cobalt aluminate (or cobalt silicate when a silica support is used). If unpromoted cobalt is used, this first reduction temperature can be increased to 400° C. to ensure full reduction. Following the first reduction step, an oxidation step at a temperature in a range of about 250° to about 300° C. is conducted, followed by a second reduction step at a temperature in a range of about 200° to about 350° C.

The synthesis gas conversion catalyst has an average particle diameter, which depends upon the type of reactor to be utilized, of from about 0.01 to about 6 millimeters; for example, from about 1 to about 6 millimeters, even from about 1 to about 3 millimeters for a fixed bed; and for example, from about 0.03 to about 0.15 millimeters for a reactor with the catalyst suspended by gas, or gas-liquid media (e.g., fluidized beds).

The dual functionality catalyst includes a hydrogenation catalyst for hydrogenating olefins and a solid acid catalyst component for isomerizing and/or cracking the straight chain hydrocarbons. The hydrogenation component is typically a metal or combination of metals selected from Group VIII noble and non-noble metals and Group VIB metals. Preferred noble metals include platinum, palladium, rhodium and iridium. Non-noble metals which can be used include molybdenum, tungsten, cobalt, etc. The non-noble metal hydrogenation metals are usually present in the final catalyst composition as oxides, when such compounds are readily formed from the particular metal involved. Preferred non-noble metal overall catalyst compositions contain in excess of about 5 weight percent, preferably about 5 to about 40 weight percent molybdenum and/or tungsten, and at least about 0.5, and generally about 1 to about 15 weight percent of cobalt determined as the corresponding oxides.

The hydrogenation component can be incorporated into the overall catalyst composition by any one of numerous procedures. It can be added either to the acid component, to the support or a combination of both. These components are usually added as a metal salt which can be thermally converted to the corresponding oxide in an oxidizing atmosphere or reduced to the metal with hydrogen or other reducing agent.

The acid component can be selected from any of the previously listed suitable materials for use as the zeolite support in the integral catalyst as described above in section 1. The relative amounts of catalysts in the catalyst mixture can be suitably varied to obtain the desired product. If the ratio of syngas conversion catalyst to dual functionality catalyst is too low, the hydrocarbon synthesis productivity will be low; whereas if this ratio is too high, there will not be enough cracking activity to keep the product hydrocarbons liquid. In general, the weight of the syngas conversion catalyst is between about 0.2 and about 2.5 times the weight of the dual functionality catalyst, depending on factors including the acidity and activity of the catalysts used, and the pressure of operation. The higher the pressure, the higher the ratio of zeolite to cobalt. In order for the dual functionality component to be present in amounts large enough to ensure that no substantial amounts of wax forms, as would allow for the elimination a separate hydrocracker, then a safety factor to allow for differential aging would be applied and one would use a high zeolite/Co ratio. The weight ratio of zeolite to cobalt within the bed of the reactor is advantageously between about 7 and about 17. The reaction temperature is suitably greater than about 210° C., for example, from about 210° C. to about 230° C., when the reactor is a fixed bed reactor. Higher reaction temperatures favor lighter products. The total pressure is greater than about 5 atmospheres, for example, from about 5 to about 25 atmospheres. Higher reaction pressures favor heavier products. The gaseous hourly space velocity based upon the total amount of feed is less than about 8,000 volumes of gas per volume of catalyst per hour.

The process can be operated at partial conversion with recycle of the dry tail gas after liquids (water and $C_{5+}$ hydrocarbon products) are removed by condensation. This protects the catalyst from high steam pressures at high conversions. Recycle of the tail gas also allows any light olefins in it to be incorporated into $C_{5+}$ liquids. The single pass CO conversion rate in the process is advantageously less than about 60%, but the overall conversion rate including recycle should be greater than about 90%.

The synthesis gas reaction of the present disclosure can occur in a fixed, fluid or moving bed type of operation.

The present process provides for a high yield of paraffinic hydrocarbons in the middle distillate and/or light base-oil range under essentially the same reaction conditions as the synthesis gas conversion. The hydrocarbons produced are liquid at about 0° C., contain at least 25% by volume $C_{10+}$ and no greater than about 5 wt % $C_{21+}$. In one embodiment, the process provides a product having the following composition:

0-20, for example, 5-15 or 8-12, weight % $CH_4$;

0-20, for example, 5-15 or 8-12, weight % $C_2$-$C_4$;

50-95, for example, 60-90 or 75-80, weight % $C_{5+}$; and 0-5 weight % $C_{21+}$.

The liquid hydrocarbon product is substantially free of a distinct solid phase of $C_{21+}$ wax, by which is meant that there is no readily visible insoluble solid wax phase at ambient conditions. As a result, there is no need to separately treat a wax phase. The liquid hydrocarbon product preferably contains less than about 5% $C_{21+}$ normal paraffins or normal olefins.

In addition, the present process provides for a high yield of paraffinic hydrocarbons in the middle distillate and/or light base-oil range without the need for separation of products and without the need for a second reactor containing catalyst for hydrocracking and hydroisomerization. The productivity rate of the process is at least 2 grams of hydrocarbon per gram of cobalt per hour when determined at 10 atm reaction pressure, 215° C. reaction temperature and a $H_2$/CO feed ratio of 1.5.

An additional advantage to the present process is that undesired methane selectivity is kept low as a result of maintaining the process temperature in the lower end of the optimum range for Fischer-Tropsch synthesis and considerably lower than what is generally believed required for adequate hydrocracking and hydroisomerization activity of pure paraffins at high LHSV. It is well known that high methane selectivity is found at the elevated temperatures commonly used for hydrocracking and hydroisomerization.

For specific examples of catalysts which have been made and products produced, see U.S. patent application Ser. No. 12/621,385.

U.S. patent application Ser. No. 12/953,042, entitled Process of Synthesis Gas Conversion to Liquid Hydrocarbon Mixtures Using a Catalyst System Containing Ruthenium and an Acidic Component, describes another mixed bed arrangement of catalysts that can be used in conversion reactor 206. The contents of this disclosure are hereby incorporated herein by reference in its entirety. The mixed bed arrangement, also referred to as the catalyst system, comprises a physical mixture of Fischer-Tropsch catalyst particles including ruthenium on a solid metal oxide support and separate particles of an acidic component, e.g., a zeolite, which has been promoted with one or more Group VIII metals to enhance hydrocracking activity and selectivity. The physically mixed catalyst particles are activated by a low-temperature reduction cycle.

The Fischer-Tropsch functionality of the catalyst system is provided by ruthenium loaded particles which can be formed by any known means for depositing a ruthenium compound onto a solid metal oxide support, including, but not limited to, precipitation, impregnation and the like. Any technique known to those having ordinary skill in the art to distend the ruthenium in a uniform manner on the support is suitable. Suitable support materials for use in the Fischer-Tropsch catalyst particles include, by way of example and not limitation, porous solid metal oxides such as alumina, silica, titania, magnesia, zirconia, chromia, thoria, boria, beryllia and mixtures thereof. Suitable methods for preparing such ruthenium loaded particles have been previously described in section 1 in the preparation of the ruthenium-based integral catalyst.

Optionally, a promoter element selected from iron (Fe), cobalt (Co), molybdenum (Mo), manganese (Mn), praseodymium (Pr), rhodium (Rh), platinum (Pt), palladium (Pd), copper (Cu), silver (Ag), gold (Au), zinc (Zn), cadmium (Cd), rhenium (Rh), nickel (Ni), potassium (K), chromium (Cr), zirconia (Zr), cerium (Ce) and niobium oxide can be added to improve the activity. Manganese and rhenium are promoters which enhance the diesel range products. Higher loadings of Ru without a promoter favor gasoline range products. For a catalyst containing about 1-5 weight % ruthenium, for example, the amount of rhenium can be from about 0.1 to about 1 weight %, for example, from about 0.05 to about 0.5 weight % based upon total catalyst weight. The amount of rhenium would accordingly be proportionately higher or lower for higher or lower ruthenium levels, respectively.

In one embodiment, no cobalt compounds are added during the Fischer-Tropsch catalyst preparation and the catalyst is essentially free of cobalt. By essentially free of cobalt is meant that the Fischer-Tropsch catalyst contains less than 0.1 weight percent cobalt.

Separately, acidic components, e.g., zeolites are extruded as shaped bodies and impregnated with one or more Group VIII promoter metal(s). The promoter metals provide for enhanced activity and stability in the hydrocracking of large hydrocarbon molecules.

Suitable acidic components are selected from any of the previously listed suitable materials for use as the zeolite support in the integral catalyst as described above in section 1.

The resulting ruthenium loaded particles and promoter metal-impregnated acidic component shaped bodies are calcined, crushed and sieved to particle sizes useful in fixed bed reactions. In one embodiment, the sized sets of particles have an average particle diameter, which depends upon the type of reactor to be utilized, of from about 0.5 to about 6 mm for a fixed bed; and for example, from about 0.01 to about 0.11 mm for a reactor with the catalyst suspended by gas, liquid, or gas-liquid media (e.g., fluidized beds, slurries, or ebullating beds).

The ruthenium loaded particles and the promoter metal-impregnated acidic component particles are mixed at a ratio that provides for the efficient conversion of Fischer-Tropsch wax into liquid products. In one embodiment, the weight ratio of acidic component to ruthenium is between 1:1 and 1000:1; in another embodiment, the weight ratio of acidic component to ruthenium is between 5:1 and 300:1; in yet another embodiment, the weight ratio of acidic component to ruthenium is between 10:1 and 100:1.

The catalyst mixture optionally contains particles of a second acidic component.

The two or more sets of particles of the catalyst system, i.e., the ruthenium loaded particles and the promoter metal-impregnated acidic component particles and optional second acidic component particles, are well mixed physically and charged to a reactor tube. In one embodiment, a multi-tubular fixed bed reactor is used.

The ruthenium content of the catalyst system will depend on the relative amounts of ruthenium loaded particles and promoted zeolite particles. For example, if one part of synthesis conversion catalyst comprised of 5% ruthenium on alumina is physically mixed with one part of alumina-bound zeolite by weight, then the resultant catalyst system will contain 2.5% ruthenium. The overall catalyst system can contain, for example, from about 1 to about 20 weight % ruthenium, preferably 1 to about 3 weight % ruthenium, based on total catalyst weight, at the lowest support content. At the highest support content the catalyst can contain, for example, from about 1 to about 20 weight % ruthenium, preferably from about 2 to about 10 weight % ruthenium, based on total catalyst weight (including binder weight).

The catalyst system, i.e., the catalyst mixture, is activated by one of a single reduction step, reduction-oxidation cycle, or reduction-oxidation-reduction cycle to increase catalytic activity resulting in improved reaction rates.

The reaction temperature is suitably from about 200° to about 350° C. When relatively low levels of acidic component are used, relatively higher reaction temperatures can be used than when relatively high levels of acidic component are used, in order to obtain a product substantially free of solid wax. For example, in one embodiment, at weight ratios of acidic component to ruthenium of less than about 50:1, the reaction temperature is preferably greater than about 250° C., even from 270° to about 350° C. In another embodiment, at weight ratios of acidic component to ruthenium of greater than about 50:1, the reaction temperature can be between 200° and 350° C., even from 220° to about 350° C.

The total pressure is, for example, from about 1 to about 100 atmospheres, for example, from about 3 to about 35 atmospheres or from about 10 to about 30 atmospheres.

The gaseous hourly space velocity based upon the total amount of feed is less than 20,000 volumes of gas per volume of catalyst per hour, for example, from about 5 to about 10,000 v/v/hour or from about 1000 to about 2500 v/v/hour. If desired, pure synthesis gas can be employed or, alternatively, an inert diluent, such as nitrogen, $CO_2$, methane, steam or the like can be added. The phrase "inert diluent" indicates that the diluent is non-reactive under the reaction conditions or is a normal reaction product.

The synthesis gas reaction using the catalyst system can occur in a fixed, fluid or moving bed type of operation. The reaction can also occur in a microchannel reactor.

The hydrocarbon mixture formed in the reaction can range from methane to light wax, containing only trace amounts (<0.5 wt %) of carbon numbers above 30, and may include linear, branched and cyclic compounds.

The combination of a ruthenium-based Fischer-Tropsch component with an acidic component (e.g., zeolite) results in enhanced selectivity for desirable products, i.e., low $CH_4$ levels, high $C_{5+}$ levels and low $C_{21+}$ n-paraffins. The branched nature of the carbon chain products make them beneficial for transportation fuels having low temperature pour, cloud or freeze points. Waxy products formed on the ruthenium component are cracked (i.e., by the acidic component) into mainly branched hydrocarbons with limited formation of aromatics. In one embodiment, in a single-stage Fischer-Tropsch reaction, the presently disclosed catalyst system provides the following at ambient conditions:

1-15 weight % $CH_4$;

1-15 weight % $C_2$-$C_4$;

70-95, weight % $C_{5+}$;

0-5 weight % $C_{21+}$ normal paraffins; and 0-10, or even 0-5, weight % aromatic hydrocarbons.

In one embodiment, the hydrocarbon mixture produced is substantially free of solid wax by which is meant that the product is a single liquid phase at ambient conditions without the visibly cloudy presence of an insoluble solid wax phase. According to this embodiment, the hydrocarbon mixture produced contains 0-5 weight % $C_{21+}$ normal paraffins at ambient conditions. In a typical Fischer-Tropsch process, the product obtained is predominantly a normal or linear paraffin product, meaning free of branching. If the $C_{21+}$ fraction present within a $C_{5+}$ product is predominantly linear and greater than 5 weight %, the product has been found to contain a separate, visible solid wax phase. Products of the present process may actually contain $C_{21+}$ at greater than 5 weight % without a visible solid wax phase. Branched paraffins have lower melting points compared with normal or linear paraffins such that products of the present process can contain a greater percentage of $C_{21+}$ fraction and still remain a liquid which is free of a separate, visible solid wax phase at ambient conditions. The result is a product which is liquid and pourable at ambient conditions. Liquid hydrocarbons produced by the present process advantageously have a cloud point as determined by ASTM D 2500-09 of 15° C. or less, even 10° C. or less, even 5° C. or less, and even as low as 2° C. By "ambient conditions" is meant a temperature of 15° C. and a pressure of atmosphere (100 kPa).

Test Methods

Wax appearance temperature (WAT) is the temperature at which wax crystals begin to form as a crude oil sample is cooled. A lower WAT is preferred, and indicates a wider temperature range over which a crude oil remains liquid. A small droplet of crude oil was heated past the melting point and slowly cooled to observe the point of wax crystallization. This was observed under an Axioplan optical microscope available from Carl Zeiss Microscopy, LLC (Thomwood, N.Y.). The temperature of the sample was controlled by a THMS600 heating and freezing microscope stage available from Linkam Scientific Instruments Ltd. (Surrey, UK) holding the sample. A digital camera attached to the microscope was used to monitor the progress of wax crystallization. The WAT was determined from the digital photographs to be the temperature at which the first wax crystals appeared as the sample was cooled.

Pour point was measured according to ASTM D5950, Standard Test Method for Pour Point of Petroleum Products (Automatic Tilt Method). Pour point is the lowest temperature at which a liquid will not flow under gravity.

American Petroleum Institute (API) gravity was measured according to ASTM D4052. API gravity is a measure of the heaviness of petroleum compared to water. Values higher than 10 indicate the substance is less dense than water, while lower values indicate increasingly heavy crudes.

Viscosity was measured at 80° C. and 40° C. (as indicated) according to ASTM D445. Viscosity specifications for tankers and refineries generally range up to about 200 to 300 cSt at ambient temperature to maintain flowability and minimize resources needed for transportation and refining. The result "wax" indicates that the sample was solid phase at the measurement temperature.

EXAMPLES

A hybrid Fischer-Tropsch catalyst containing 7.5 weight % Co and 0.19 weight % Ru on a support containing 80 weight % ZSM-12 and 20 weight % alumina was prepared and activated as described in Example 1 of U.S. Pat. No. 7,943,674. Ten grams of the catalyst was charged to a glass tube reactor and contacted with synthesis gas having a hydrogen to carbon monoxide ratio of 2.0 at a temperature of 220° C., a total pressure of atm and a flow rate of 1200 $mL_{gas}/g_{cat}/h$. Clear synthetic crude oil having a pour point of −27° C., an API gravity of 53.8 and having no wax content, i.e., less than 5 wt. % $C_{21+}$ normal paraffins, was produced.

Samples of the clear synthetic crude oil (Sample A) were blended into samples of medium natural crude samples having an API gravity of 29.8 (Sample B) at 5, 10, 15, and 25 wt % (Examples 1-4, respectively).

Each natural crude sample was placed in a flask and heated slowly in a sand bath at 120° C. The synthetic crude oil sample was added and the samples were mixed with a stir bar until the blend was homogenized. After the blend was allowed to cool, it was portioned into vials for further analyses.

A conventional Fischer-Tropsch catalyst containing 20 wt % cobalt, 0.5 wt % ruthenium and 1.0 wt % lanthanum oxide supported on alumina was prepared and activated as described in Example 5 of U.S. Patent Publication No. 2010/0312030A1. Ten grams of the catalyst was charged to a glass tube reactor and contacted with synthesis gas having a hydrogen to carbon monoxide ratio of 2.0 at a temperature of 220° C., a total pressure of atm and a flow rate of 1200 $mL_{gas}/g_{cat}/h$. A waxy synthetic crude oil containing 50 wt % wax was produced.

Blends with samples of medium natural crude were similarly prepared using the waxy hydrocarbon product (Sample C) blended into the medium natural crude (Sample B) (Comparative Examples 1-4, respectively).

The example and comparative example blends were then analyzed for wax appearance temperature (WAT), pour point, and viscosity. The results are provided in Table 1.

The blended crude samples containing Sample A, the clear synthetic crude made according to the present process, exhibited decreased pour point, decreased WAT, and decreased viscosity, i.e., improved flow characteristics as compared with blended crude samples containing Sample D, the conventional waxy FT product, for all percentages of syncrude. The blended crude samples containing Sample A also exhibited decreased viscosity at syncrude content greater than 5 wt % as compared with blended crude samples containing conventional waxy FT product. All of the flow characteristics were found to improve with increasing synthetic crude content for blends containing Sample A.

Figure 3:
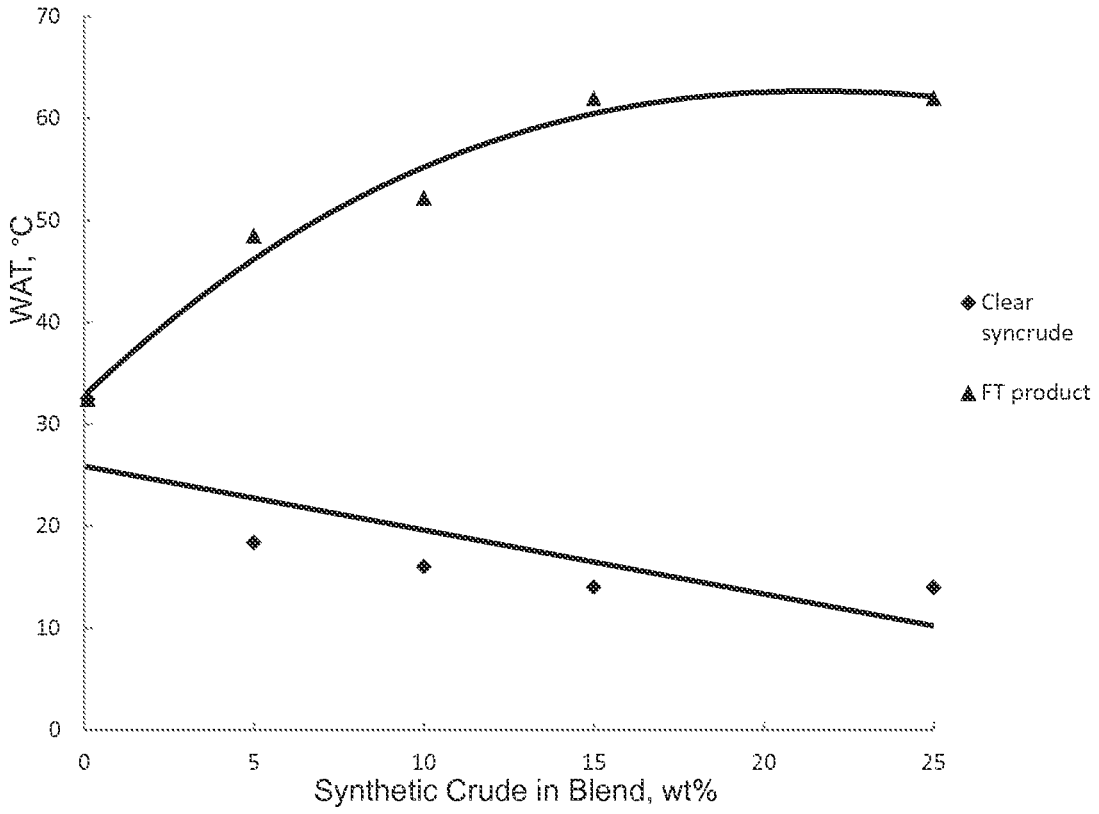
FIG. 3 is a graph comparing wax appearance temperature measurements of a blend of natural crude oil with a wax-free synthetic crude oil with those of a blend of natural crude oil with a conventional waxy Fischer-Tropsch synthetic crude oil.

The addition of clear synthetic crude products made according to the present process (Sample A) favorably decreased the WAT by as much as 57% at the highest blending fraction (25 wt %) as compared with the WAT of the natural crude oil. By contrast, the addition of the conventional waxy FT product (Sample C) to the natural crude oil unfavorably increased WAT by up to 91%. Refer to FIG. 3 for a graph comparing WAT measurements of blends of the medium natural crude oil with the clear, wax-free synthetic crude oil with those of blends of the medium natural crude oil with the conventional waxy Fischer-Tropsch synthetic crude oil.

Figure 4:
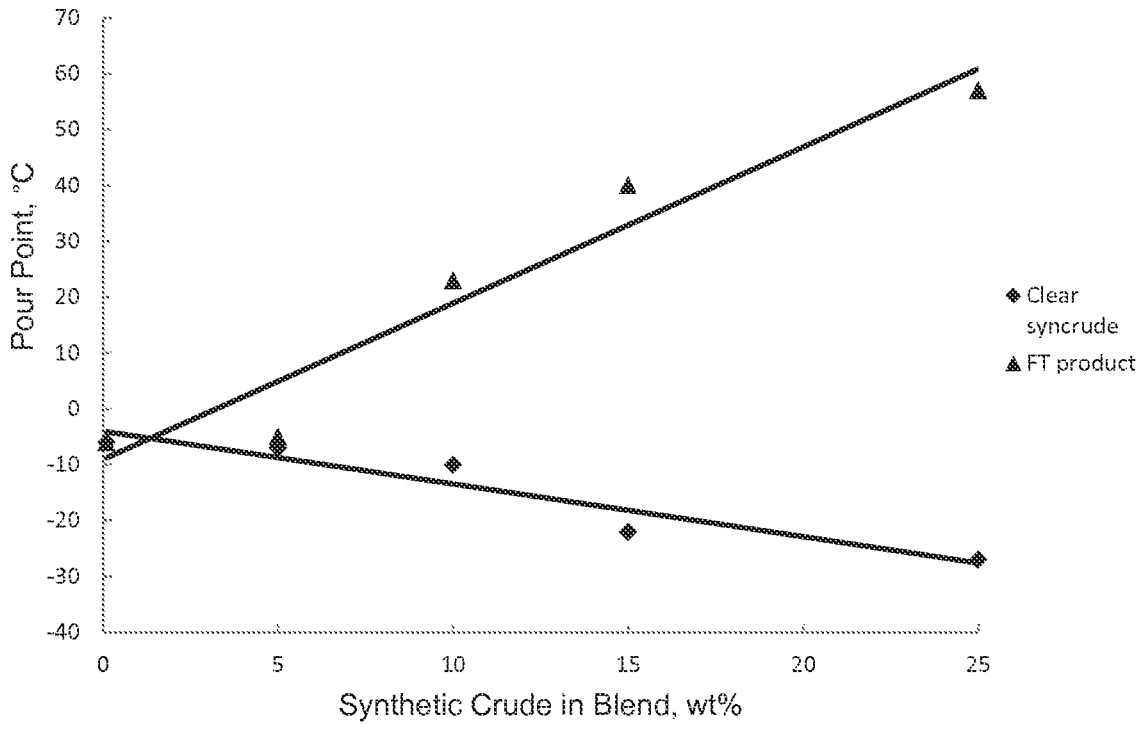
FIG. 4 is a graph comparing pour point measurements of a blend of natural crude oil with a wax-free synthetic crude oil with those of a blend of natural crude oil with a conventional waxy Fischer-Tropsch synthetic crude oil.

The addition of clear synthetic crude was found to lower the pour point of the blended crude as compared to the medium natural crude by up to 67% (at a 10 wt % blending ratio). Refer to FIG. 4 for a graph comparing pour point measurements of blends of the medium natural crude oil with the clear, wax-free synthetic crude oil with those of blends of the medium natural crude oil with the conventional waxy Fischer-Tropsch synthetic crude oil.

Figure 5:
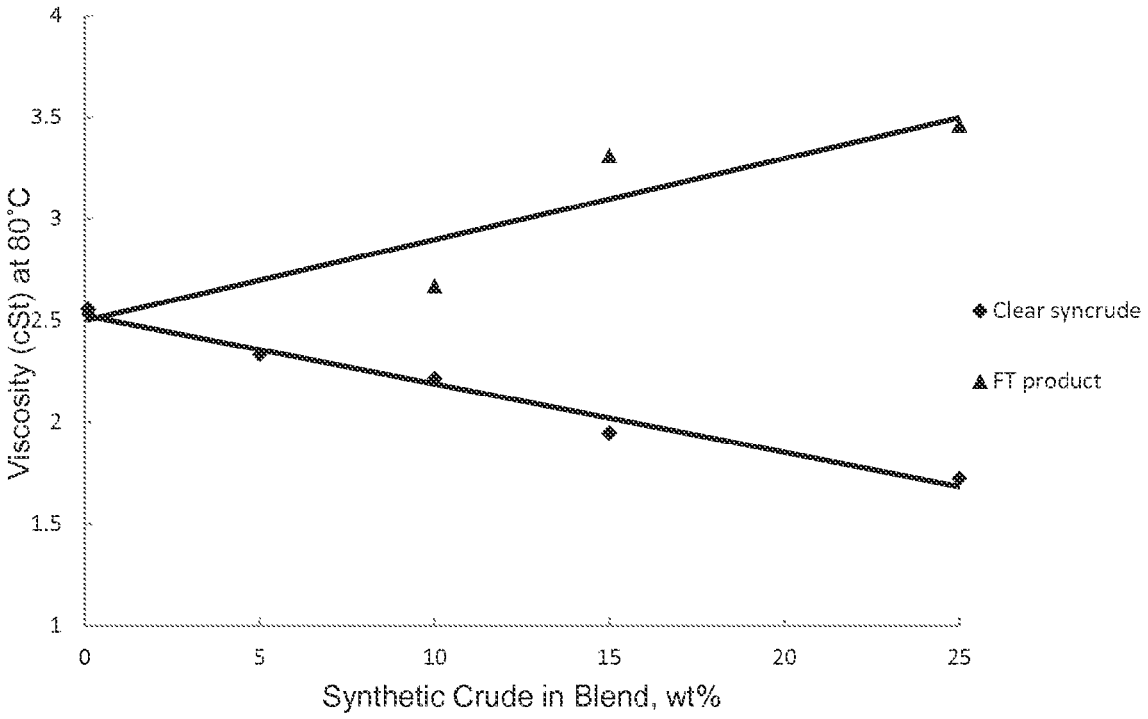
FIG. 5 is a graph comparing viscosity measurements of a blend of natural crude oil with a wax-free synthetic crude oil with those of a blend of natural crude oil with a conventional waxy Fischer-Tropsch synthetic crude oil.

Refer to FIG. 5 for a graph comparing viscosity at 80° C. of blends of the medium natural crude oil and the clear, wax-free synthetic crude oil with viscosity of blends of the medium natural crude oil and conventional waxy Fischer-Tropsch synthetic crude oil.

As FIGS. 3-5 illustrate, blending clear syncrude material into medium natural crude oil results in reduced wax appearance temperature, pour point, and viscosity, respectively, which each decrease approximately linearly with increasing syncrude content. By contrast, blending conventional waxy synthetic crude oil into the same natural crude oil increases these flow properties compared to the unblended natural crude oil. The wax appearance temperature, pour point, and viscosity of these blends all increase with increasing waxy syncrude content.

Samples of clear synthetic crude oil Sample A were also blended into samples of heavy natural crude having an API gravity of 13 (Sample D) at 3, 5, 10, 15, and 25 wt % syncrude (Examples 5-9, respectively). Blends were similarly prepared using samples of conventional waxy FT product (Sample C) blended into the heavy natural crude (Sample D) at 3, 5, 7 and 10 wt % (Comparative Examples 5-8, respectively).

The blends were then analyzed for wax appearance temperature (WAT), pour point, and viscosity. The results are provided in Table 2.

TABLE 1

| | Sample | Sample | Sample | Ex. 1 | Ex. 2 | Ex. 3 | Ex. 4 | Comp. Ex. 1 | Comp. Ex. 2 | Comp. Ex. 3 | Comp. Ex. 4 |
|---|---|---|---|---|---|---|---|---|---|---|---|
| Syncrude | A | | C | A | A | A | A | C | C | C | C |
| Natural crude | | B | | B | B | B | B | B | B | B | B |
| Wt. % syncrude | 100 | 0 | 100 | 5 | 10 | 15 | 25 | 5 | 10 | 15 | 25 |
| WAT (° C.) | <25 | 32.5 | no data | 18.4 | 16 | 14 | 14 | 48.5 | 52.2 | 62 | 62 |
| Pour Point (° C.) | −27 | −6 | 56 | −7 | −10 | −22 | −27 | −5 | 23 | 40 | 57 |
| Viscosity (cSt) at 80° C. | 0.802 | 2.56 | no data | 2.33 | 2.21 | 1.95 | 1.72 | no data | 2.67 | 3.31 | 3.46 |
| API Gravity (degrees) | 53.8 | 29.8 | 37.3 | 31.2 | 31.9 | 33.6 | 35.6 | 30.6 | 31.3 | 32.6 | 34.4 |

TABLE 2

| | Sample | Sample | Sample | Ex. 5 | Ex. 6 | Ex. 7 | Ex. 8 | Ex. 9 | Comp. Ex. 5 | Comp. Ex. 6 | Comp. Ex. 7 | Comp. Ex. 8 |
|---|---|---|---|---|---|---|---|---|---|---|---|---|
| Syncrude | A | C | | A | A | A | A | A | C | C | C | C |
| Natural crude | | | D | D | D | D | D | D | D | D | D | D |
| Wt. % syncrude | 100 | 100 | 0 | 3 | 5 | 10 | 15 | 25 | 3 | 5 | 7 | 10 |
| WAT (° C.) | <25 | no data | 47 | 48.5 | 43.2 | 51 | 47 | 48 | 58 | 58 | 57 | 54.5 |
| Pour Point (° C.) | −27 | 56 | −1 | −4 | −7 | −30 | −25 | −38 | 5 | 0 | −5 | 20 |
| Viscosity (cSt) at 40° C. | 1.2 | Wax | 5.6 | no data | 2810 | 1300 | 414 | 88.5 | 8.63 | Wax | Wax | Wax |

TABLE 2-continued

| | Sample | Sample | Sample | Ex. 5 | Ex. 6 | Ex. 7 | Ex. 8 | Ex. 9 | Comp. Ex. 5 | Comp. Ex. 6 | Comp. Ex. 7 | Comp. Ex. 8 |
|---|---|---|---|---|---|---|---|---|---|---|---|---|
| Viscosity (cSt) at 80° C. | 0.80 | no data | no data | 233 | no data | 156 | 85.1 | no data | no data | no data | no data | no data |
| API Gravity (degrees) | 53.8 | 37.3 | 13 | 14.9 | 15.5 | 15.2 | 17.3 | 25.4 | 13.7 | 14.2 | 15.0 | 15.8 |

These results indicate that blends of synthetic crude made according to the present process and natural crude oil have improved flow characteristics, i.e., wax appearance temperature, pour point and viscosity, when compared to the natural crude and when compared to natural crude blended with conventional FT waxy synthetic crude. The blends of the present disclosure thus have improved transportability since such blends are less likely to precipitate wax on solid surfaces during transportation and shipping. It has been shown that blending conventional FT waxy synthetic crude worsens the transportability of the natural crude, even at the small percentages available from the conversion of associated gas. By contrast, the flow characteristics, i.e., wax appearance temperature, pour point and viscosity, have been shown to improve (decrease) with increasing percentage of synthetic crude oil added. Depending on the amount of associated gas present, the difference between the flow characteristics of a blend containing synthetic crude made according to the present process and a blend containing conventional FT waxy synthetic crude can result in a large difference in the cost of transportation between the two blends.

A consequence of the presently disclosed processes and systems is that the ratio of associated gas to oil (gas/oil ratio, GOR) of an oilfield is no longer a factor which could limit oil production or prohibit oil production from the oilfield. In offshore oil production, flaring of associated gas is environmentally undesirable and increasingly subject to legal restrictions. In order to avoid flaring, the associated gas can be converted to synthetic crude by means of a Fischer-Tropsch process and the resulting FT waxy product can be blended into the natural crude. However, as has been stated, the resulting FT waxy product can only be handled in limited quantities; otherwise operational expenses are greatly increased due to the need for heated pipelines, vessels, and tankers. Greater amounts of associated gas could be processed without creating operational difficulties if the FT waxy product were further subjected to hydrocracking. However, this is undesirable for the additional capital expense and for the additional equipment that would need to be present on the vessel or platform. Through the use of the present processes and systems, there is no limit to the amount of associated gas that can be converted to synthetic crude and blended with natural crude to produce a blend with desirable properties which would avoid difficulties caused by the presence of wax. For instance, the present processes and systems can be used to handle the associated gas in oilfields having a gas to oil ratio of greater than 50 scf/bbl, even greater than 1000 scf/bbl, volatile oil-producing fields having a gas to oil ratio of 2000-3000 scf/bbl, near critical oil-producing fields having a gas to oil ratio of 3000-8000 scf/bbl, and even gas condensate producing fields having a gas oil ratio of 8000-70,000 scf/bbl.

Those skilled in the art will appreciate that other combinations of synthetic gas conversion catalyst and the hydroconversion catalyst may be used in a single conversion reactor to produce an effluent stream containing synthetic crude oil which may then be sent to a separation complex such that a blended stabilized crude oil may be produced which can be transported on a conventional crude oil tanker. Preferably the blended stabilized crude has a pour point at or below 30° C. and comprises at least 2 wt % of the synthetic crude oil.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention.

For example, while it is preferred that the synthetic crude oil that is produced from the reactor is generally wax free and has a pour point below 30° C., it is possible that a conventional Fischer-Tropsch reactor and product may be used. In this case, conventional hydrotreating, i.e. separate hydrocracking and hydroisomerization units could be used to produce liquid products generally free of wax. This low wax, liquid product could then be routed to separation complex 28 to be separated into gas and liquids. The blended liquid product and crude oil can then be sent to stabilizer 144 to have gas removed so that a blended stabilized product 146 could be produced that readily meets shipping standards for conventional crude oil tankers.

Where permitted, all publications, patents and patent applications cited in this application are herein incorporated by reference in their entirety; to the extent such disclosure is not inconsistent with the present invention.

Unless otherwise specified, the recitation of a genus of elements, materials or other components, from which an individual component or mixture of components can be selected, is intended to include all possible sub-generic combinations of the listed components and mixtures thereof. Also, "include" and its variants, are intended to be non-limiting, such that recitation of items in a list is not to the exclusion of other like items that may also be useful in the materials, compositions and methods of this invention.

What is claimed is:

1. A process for producing a blended stabilized crude oil from a stream of produced fluids produced from a hydrocarbon containing subterranean reservoir, the process comprising:

(a) converting synthesis gas in a conversion reactor, in the presence of a synthesis gas conversion catalyst and a hydroconversion catalyst, into a tail gas and a liquid effluent stream including liquefied petroleum gas and synthetic crude oil; and (b) sending at least a portion of the liquid effluent stream to a separator and separating the liquefied petroleum gas from the synthetic crude oil; and (c) producing a blended stabilized crude oil containing natural crude oil obtained from produced fluids produced from the hydrocarbon containing subterranean reservoir and the synthetic crude oil;

wherein the blended stabilized crude oil has a pour point at or below 30° C. and comprises at least 2 wt % of the synthetic crude oil.

2. The process of claim 1, further comprising:

prior to step (a), separating natural gas from produced fluids produced from a hydrocarbon bearing reservoir, and converting the natural gas to the synthesis gas.

3. The process of claim 2, further comprising:

separating liquefied petroleum gas from produced fluids produced from a hydrocarbon bearing reservoir; and converting the liquefied petroleum gas to the synthesis gas.

4. The process of claim 1, further comprising:

prior to step (c), separating liquefied petroleum gas from natural crude oil obtained from produced fluids produced from the hydrocarbon bearing reservoir.

5. The process of claim 1, wherein the blended stabilized crude oil has a wax appearance temperature less than the wax appearance temperature of the natural crude oil.

6. The process of claim 1, wherein the wax appearance temperature of the blended stabilized crude oil decreases with increasing percentage of synthetic crude oil.

7. The process of claim 1, wherein the blended stabilized crude oil has a pour point less than the pour point of the natural crude oil.

8. The process of claim 1, wherein the pour point of the blended stabilized crude oil decreases with increasing percentage of synthetic crude oil.

9. The process of claim 1, wherein the blended stabilized crude oil has a viscosity less than the viscosity of the natural crude oil.

10. The process of claim 1, wherein the viscosity of the blended stabilized crude oil decreases with increasing percentage of synthetic crude oil.

11. The process of claim 1, wherein the produced fluids produced from the hydrocarbon bearing reservoir contain gas and oil at a gas to oil ratio of greater than 50 scf/bbl.

12. The process of claim 1, wherein the produced fluids produced from the hydrocarbon bearing reservoir contain gas and oil at a gas to oil ratio of greater than 2000 scf/bbl.

13. The process of claim 1, wherein the produced fluids produced from the hydrocarbon bearing reservoir contain gas and oil at a gas to oil ratio of greater than 8000 scf/bbl.

14. The process of claim 1, wherein the step of converting the synthesis gas occurs at a temperature between 160 and 350° C.

15. The process of claim 1, wherein the conversion of the synthesis gas into a tail gas and a liquid effluent stream occurs in a single reactor and the synthetic crude oil is not further hydrocracked.

16. The process of claim 1, wherein the process occurs at a location offshore.

17. The process of claim 1, wherein water is separated from the liquid effluent stream and the water depleted effluent stream containing synthetic crude oil and liquefied petroleum gas is sent to the separator and the liquefied petroleum gas and synthetic crude oil are separated using a stabilizer.

18. The process of claim 1, wherein no separation of a condensed $C_{5+}$ hydrocarbon phase from the synthetic crude oil is conducted prior to step (c).

19. The process of claim 1, wherein the synthesis gas conversion catalyst and the hydroconversion catalyst are both disposed on integral particles.

20. The process of claim 1, wherein the synthesis gas conversion catalyst is located in an upstream bed and the hydroconversion catalyst is located in a downstream bed of the conversion reactor in a stacked bed configuration.

21. The process of claim 1, wherein the synthesis gas conversion catalyst and the hydroconversion catalyst are disposed on discrete particles which are mixed together to form a single mixed bed of catalysts.

22. The process of claim 1, wherein the effluent stream has a water-free, $C_{5+}$ portion having a pour point at or below 30° C.

* * * * *